US007337567B2

(12) United States Patent
Fritsche et al.

(10) Patent No.: US 7,337,567 B2
(45) Date of Patent: Mar. 4, 2008

(54) RETRACTABLE BANNER STAND WITH CURVATURE MEANS

(75) Inventors: Mark A. Fritsche, Eagan, MN (US); Dan D. Berg, St. Paul, MN (US); Jason W. Johnson, Minneapolis, MN (US); John T. Elliott, Eagan, MN (US)

(73) Assignee: Skyline Displays, Inc., Eagan, MN (US)

( * ) Notice: Subject to any disclaimer, the term of this patent is extended or adjusted under 35 U.S.C. 154(b) by 371 days.

(21) Appl. No.: 11/000,855

(22) Filed: Dec. 1, 2004

(65) Prior Publication Data

US 2008/0005945 A1 Jan. 10, 2008

(51) Int. Cl.
*G09F 17/00* (2006.01)

(52) U.S. Cl. ..... 40/603; 40/514; 40/606.12

(58) Field of Classification Search ..... 40/603, 40/606.12, 518, 514, 610; 160/238, 290.1; 359/451, 443, 461

See application file for complete search history.

(56) References Cited

U.S. PATENT DOCUMENTS

| | | | | |
|---|---|---|---|---|
| 516,018 | A | 3/1894 | Lauer | |
| 565,192 | A * | 8/1896 | Waterhouse | 160/56 |
| 1,071,158 | A | 8/1913 | Hurlburt | |
| 1,330,447 | A * | 2/1920 | Pech | 359/451 |
| 1,700,637 | A * | 1/1929 | Lamb | 160/244 |
| 2,498,855 | A * | 2/1950 | Hutt | 40/603 |
| 2,855,241 | A | 12/1958 | Walter | |
| 3,069,198 | A | 12/1962 | Winn | |
| 3,075,805 | A * | 1/1963 | Golde et al. | 296/98 |
| 3,092,174 | A | 6/1963 | Winn | |
| 4,658,560 | A | 4/1987 | Beaulien | |
| 5,067,546 | A | 11/1991 | Jeuffray et al. | |

(Continued)

FOREIGN PATENT DOCUMENTS

| | | |
|---|---|---|
| WO | WO 00/47508 | 8/2000 |

(Continued)

OTHER PUBLICATIONS

Banner Lite™, Portable Display Systems, Radius® Portable Display Systems, Hanna Design, undated, 4 sheets.

(Continued)

*Primary Examiner*—Lesley D. Morris
*Assistant Examiner*—Christopher E Veraa
(74) *Attorney, Agent, or Firm*—Patterson, Thuente, Skaar & Christensen, P.A.

(57) ABSTRACT

A retractable banner stand has a banner, a support base, a mast, a retracting mechanism, and a means for imparting a curvature in the horizontal plane on the banner. Typically a cross member will be provided for supporting the banner in an extended upright position and typically the base will be a housing that included the retracting mechanism. The means for imparting a curvature may comprise a pair of elongate forms each with a banner engaging area that has a curved surface. The elongate forms can be resiliently flexible to repeatably provide and release the curved surface upon set-up and take-down. Various means for holding the resiliently flexible form in place include hinged spacers, slidable spacers, hinged form, or slidable form connected to the base. Alternatively, the curved surface may be rigid and insertable into engagement with the banner.

22 Claims, 30 Drawing Sheets

U.S. PATENT DOCUMENTS

| | | | | |
|---|---|---|---|---|
| 5,647,154 | A * | 7/1997 | Groves | 40/584 |
| 5,787,621 | A * | 8/1998 | Leksell | 40/607.03 |
| 5,798,861 | A * | 8/1998 | Doat | 359/461 |
| 6,079,474 | A | 6/2000 | Lin | |
| 6,115,951 | A * | 9/2000 | Jing et al. | 40/610 |
| D468,362 | S | 1/2003 | Zarelius | |
| 6,546,990 | B2 * | 4/2003 | Peeters | 160/370.22 |
| 6,571,496 | B2 | 6/2003 | Zarelius | |
| 6,659,159 | B2 * | 12/2003 | Fritsche et al. | 160/371 |
| 6,676,205 | B2 | 1/2004 | Lin | |
| 7,040,372 | B2 * | 5/2006 | Johansson et al. | 160/24 |
| 7,163,044 | B2 * | 1/2007 | Kirby | 160/262 |
| 2002/0050083 | A1 | 5/2002 | Zarelius | |
| 2003/0116997 | A1 | 6/2003 | Lin | |

FOREIGN PATENT DOCUMENTS

| | | |
|---|---|---|
| WO | WO 01/35381 | 5/2001 |
| WO | WO 01/91092 | 11/2001 |

OTHER PUBLICATIONS

Innovative Banner Stands, Evan Evans Group, www.evanevans.com.au/pdf/innovativebannerstands.pdf, undated, 2 sheets.

Innovative Banner Stands, Evan Evans Group, www.evanevans.com.au/pdf/innovativebannerstands.pdf, undated, 2 sheets.

* cited by examiner

RETRACTABLE BANNER STAND WITH CURVATURE MEANS

FIELD OF THE INVENTION

This invention relates to free standing and readily dissassembleable graphic displays such as those used for trade shows. More particularly, this invention relates to retractable banner stands.

BACKGROUND OF THE INVENTION

Displays for trade shows are typically collapsible structures that can be easily transported, easily erected, and easily collapsed. Such displays can also divide space and support visual graphical displays for viewing by attendees. One pleasing aspect of such displays is providing some depth such as providing a smooth flowing curved display surface. One common structure for use at trade shows utilizes a network of support rods that expand into a volumetrically substantial three-dimensional space. Such expanded structures are then covered with sheet material capable of supporting graphics on the material. See U.S. Pat. No. 4,658,560 assigned to Skyline Displays, Inc., the owner of the instant application. These displays readily provide an attractive smooth curved surface for the graphics.

Alternative collapsible displays are retractable banner stands. These stands are widely used in reception areas, trade shows, museums, art exhibits, academic and research society meetings, advertising displays, and other areas in which visual information is temporarily displayed. Such banner stands can be seen in U.S. Pat. No. 6,571,496, D468,362, U.S. Patent Application Publication 2002/0050083, and PCT Application Nos. WO 01/91092, WO 01/35381, and WO 00/47508, which are all directed to various aspects of retractable banner stands. These applications and publications are incorporated by reference herein in illustrating conventional retractable banner stand mechanisms and components.

In order to give the retractable banner stands depth, those using banner stands often arrange and connect a series of banner stands, giving the collective series such depth. When arranged in this manner, the series creates a multi-faceted display, each facet containing a portion of an overall display. This provides an attractive display, but due to the nature of retractable banners, each banner forms a planar facet that is flat. This can be distracting and can present an awkward looking graphic, particularly where an image is continuous between the adjacent facets.

It would be desirable that the retractable banner stands include means to impart a smooth curve to the banner so that a single banner stand can have the aforementioned depth and welcoming feel. It would also desirable that the banner stand include a connection mechanism that provides for the easy removal or exchange of banners from the core or retractor or from the leader. Moreover, it is desirable that the retractable banner stand can be quickly and easily assembled and disassembled to accommodate a variety of display sizes and configurations, storage, and transportation to another site. It is also desirable that two or more of the retractable banner stands with curvature means can be placed adjacent to one another and securely connected so that a series of banners creates a semicircle, arc, or overall curved appearance.

SUMMARY OF THE INVENTION

A preferred embodiment of the present invention comprises a banner, a support base, cross member, a retracting mechanism, and a means for imparting a curvature in the horizontal plane on the banner. Typically, a cross member will be provided for supporting the banner in an extended upright position and the base will be a housing that included the retracting mechanism. The means for imparting a curvature may comprise a pair of elongate forms each with a banner engaging area that has a curved surface. The elongate forms can be resiliently flexible to repeatably provide and release the curved surface upon set-up and take-down. Various means for holding the resiliently flexible form in place include hinged spacers, slidable spacers, hinged form, or a slidable form connected to the base. Alternatively, the curved surface may be fixed and insertable into engagement with the banner, cross member, or both that imparts the curve to the banner. The means could also comprise a flexible retracting core mechanism and corresponding form attached the cross member also imparting a curve on the banner.

A feature and advantage of particular embodiments of the invention is that the retractable banner stand includes a means to impart a curve to the banner while it is being dispensed from a retractor or once it has been fully dispensed from a retractor. By doing so, a single banner stand has depth and feel, thus attracting attention and inviting consumers and attendees to visit the booth or display.

Another feature and advantage of particular embodiments of the invention is that the banner stand includes a connection mechanism that provides for the easy removal or exchange of banners from the core or from the leader. Advertisers or promoters can change banners with minimal effort, thus saving them time and allowing them to easily change displays during the course of a tradeshow or event.

Another feature and advantage of particular embodiments of the invention is that the retractable banner stand with curvature means can be quickly and easily assembled and disassembled to accommodate a variety of display sizes and configurations, storage, and transportation to another site.

Another feature and advantage of particular embodiments of the invention is that two or more of the retractable banner stands with curvature means can be placed adjacent to one another and may be connected so that a series of banners create a semicircle or arc. By doing so, the display may be continuous and smooth from one display banner to the next adjacent banner.

DETAILED DESCRIPTION OF THE DRAWINGS

Figure 1:
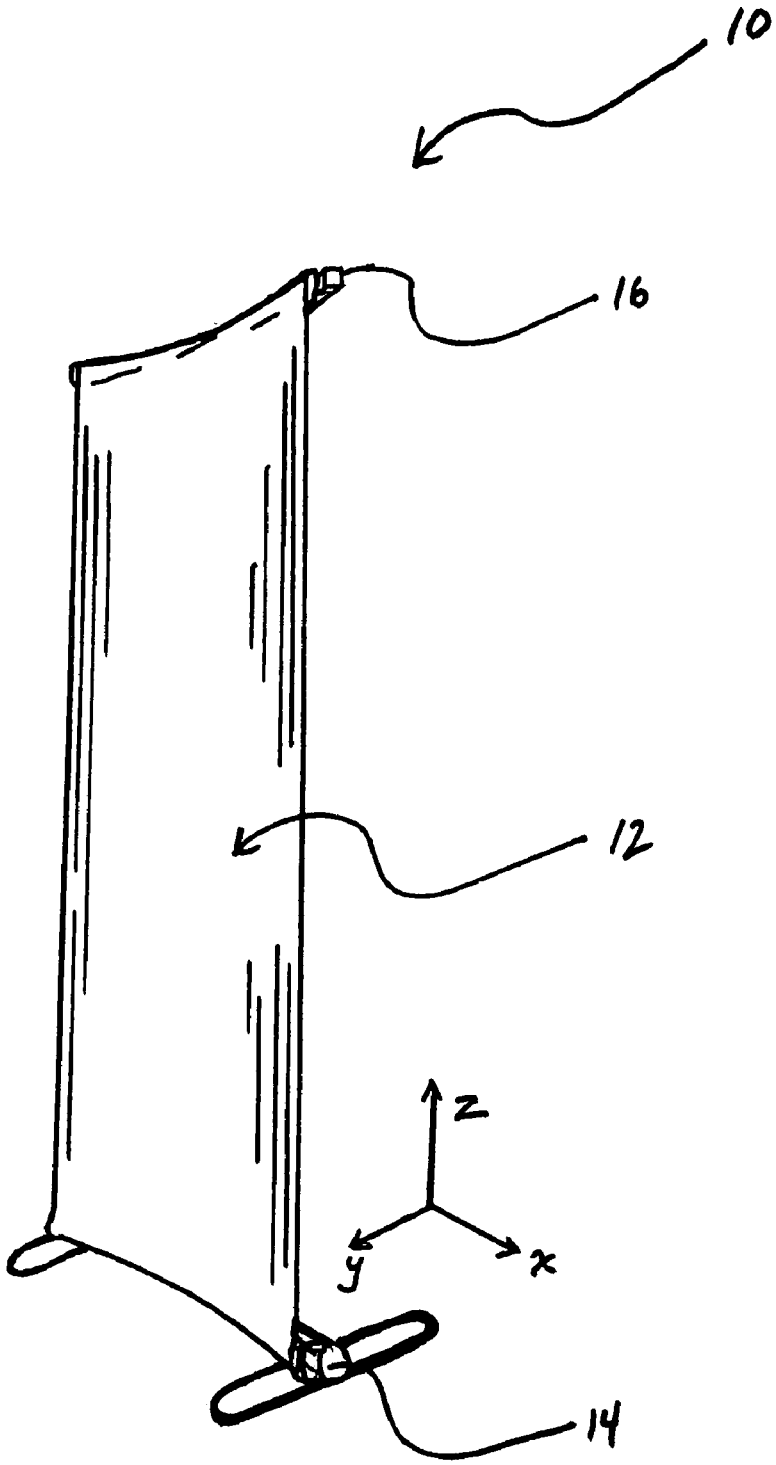
FIG. 1 is a front perspective view of a retractable banner stand according to an embodiment of the present invention.
Figure 2:
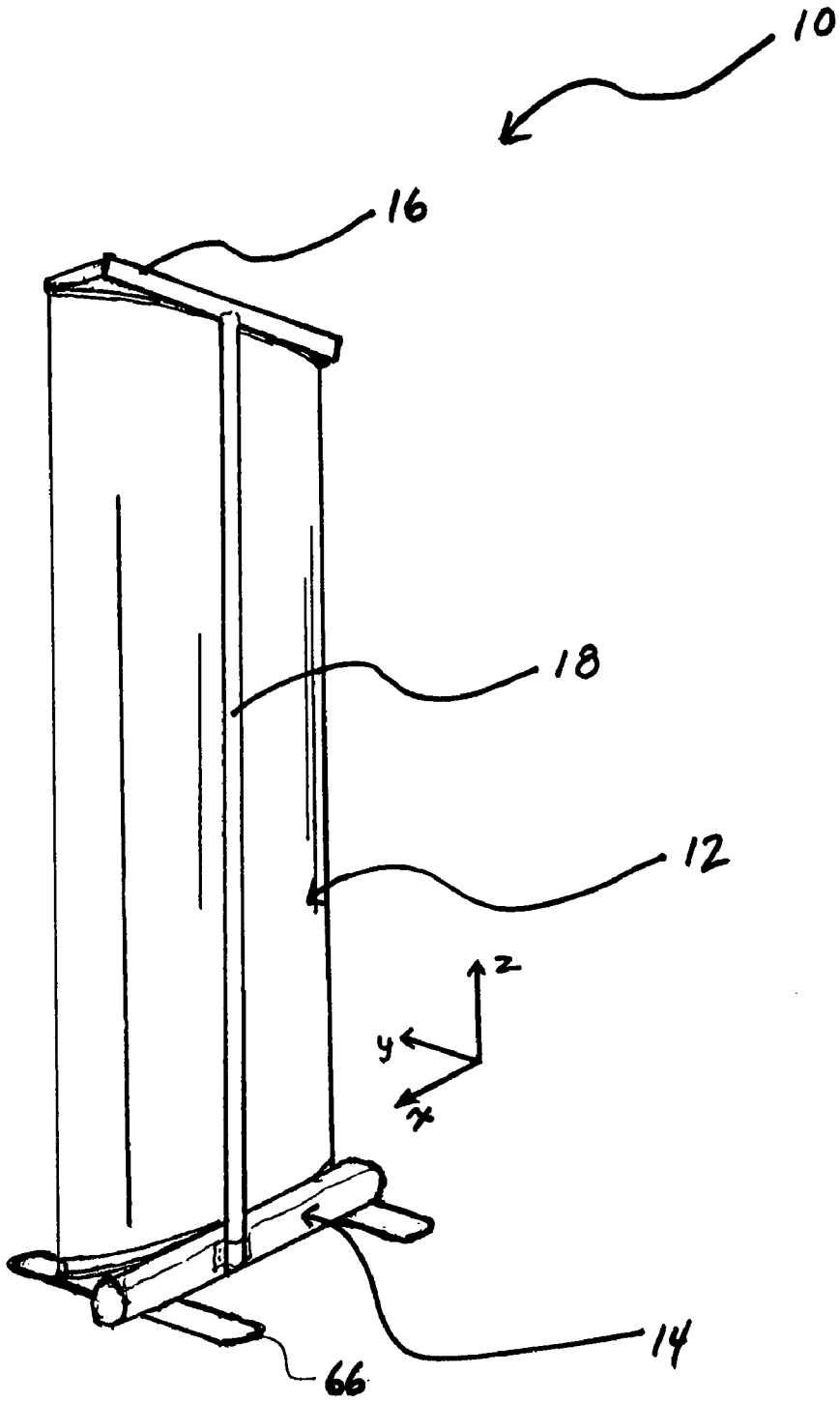
FIG. 2 is a rear perspective view of a retractable banner stand according to an embodiment of the present invention.

As can be seen in FIGS. 1-2, a retractable banner stand 10 according to the present invention generally comprises a banner 12 preferably having graphics, a base 14, and a post 18 having a cross member 16. While the retractable banner stands 10 in FIGS. 1-2 are depicted in a fully dispensed or erected upright mode, a retractable banner stand 10 in a fully retracted or collapsed transport mode can be seen in FIGS. 6-7.

When used herein, "substantially" includes precisely the characteristic or value identified. "Connect" and other forms of the word, does not require direct physical contact and intermediate components may be present.

Figure 3:
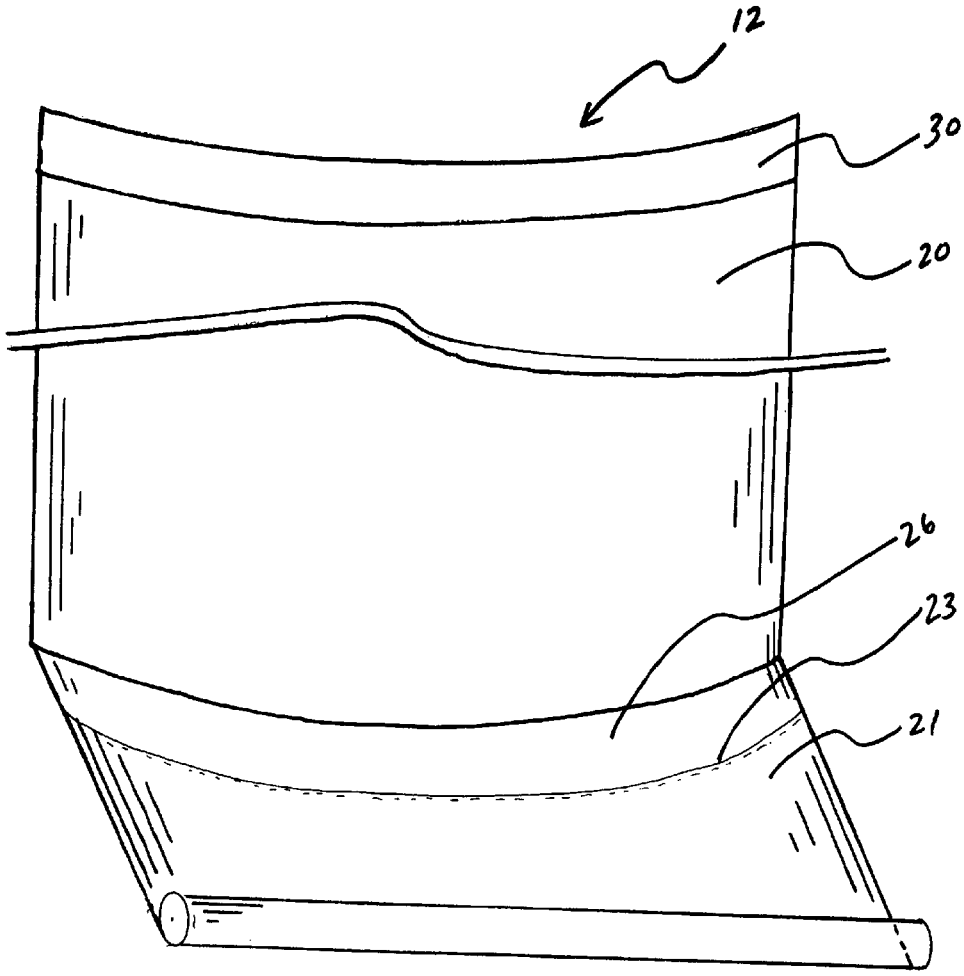
FIG. 3 is a rear perspective view of the banner of a retractable banner stand according to an embodiment of the present invention.
Figure 4:
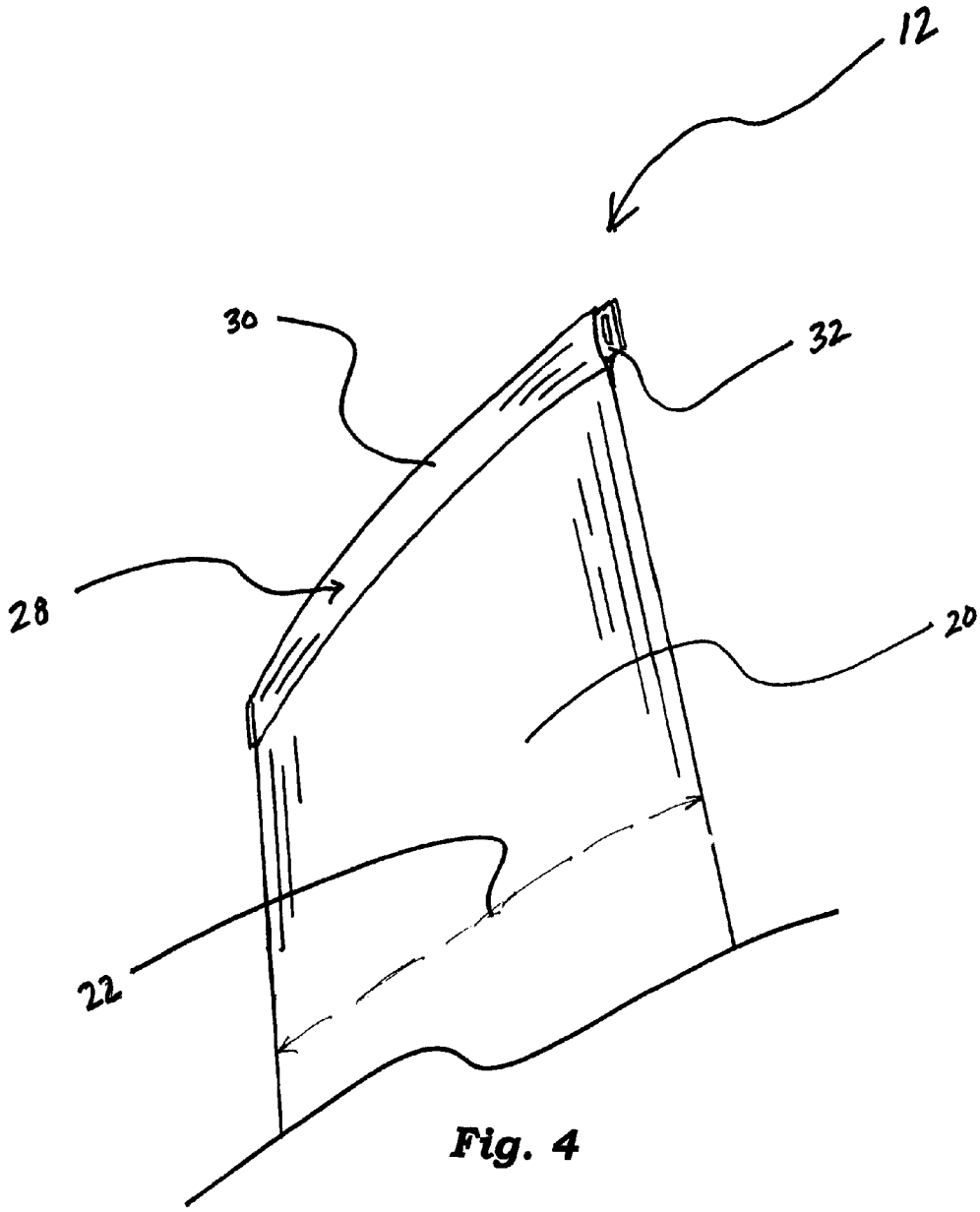
FIG. 4 is a rear perspective view of the banner of a retractable banner stand according to an embodiment of the present invention.
Figure 5:
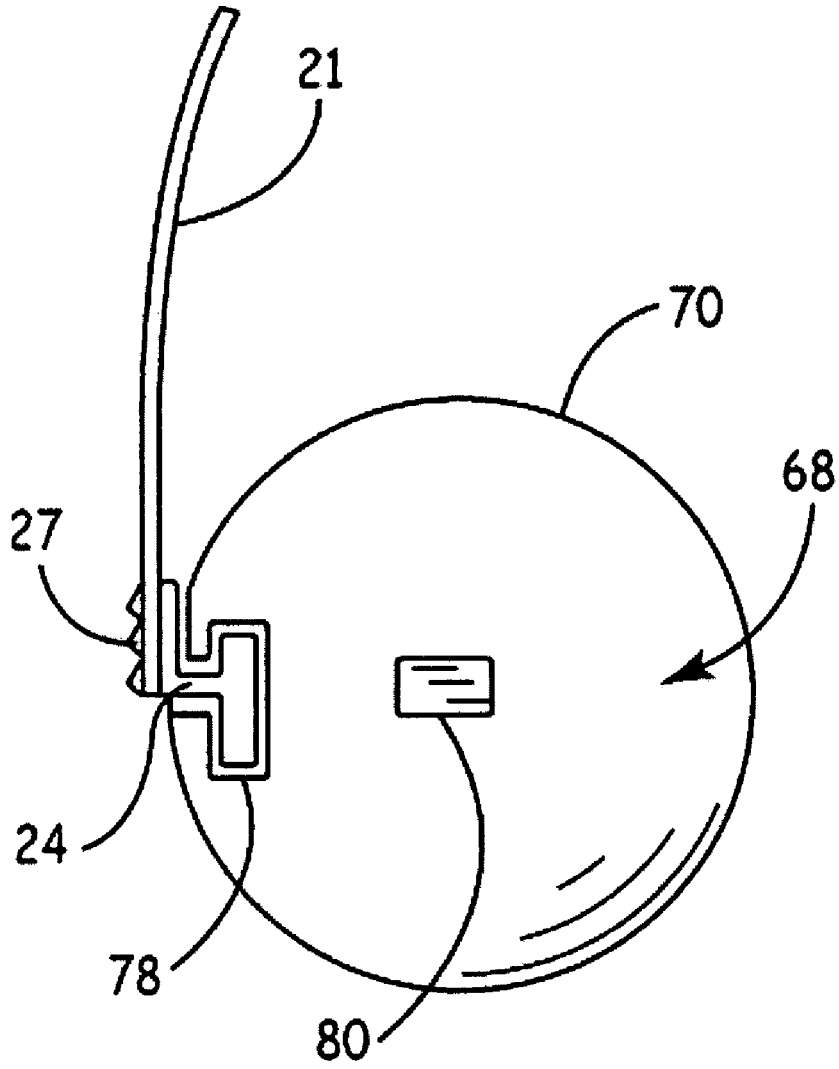
FIG. 5 is a side elevation view of a retractable banner stand according to an embodiment of the present invention.

As depicted in FIGS. 3-5, the banner 12 of the present invention preferably comprises a sheet 20 having a banner width 22, a leader or lead-in portion 21 connected to a bottom end 26 of the sheet 20 at a junction 23, an exchange member 24 connected to the leader 21 opposite the junction 23, and a header 28 located on the sheet 20 opposite the bottom end 26. The banner 12 preferably further includes a pocket 30 proximate the header 28 and a top strip 32 slidably engaging and fitting within the pocket 30. In an embodiment of the present invention in which the graphics are printed onto the banner 12 using a printer, such as an ink-jet or laser printer, the pocket 30 is not required. In this embodiment, the bottom end 26 of the sheet 20 can be taped directly to an exchange member 24.

The sheet 20 is preferably fabricated using a flexible-foldable material such poplin, but can be made out a number of materials including, but not limited to, various textiles, polyplastic, and LYCRA®. The leader is preferably fabricated using a stretchable material such as LYCRA®, but can be made out a number of materials. The leader material is preferably more stretchable than the banner material by more than 20% and has a warp stretch between 135 and 165 at 30 lbs. The leader material preferably has a side stretch between 70 and 90 at 30 lbs. These stretch values are obtained using a stretch test performed per ASTM D4964 While the preferred embodiment of the banner 12 comprises a stretchable leader 21, it is contemplated that the sheet 20 be fabricated using a stretchable material such as LYCRA®, the sheet being connected to the exchange member 24 at the bottom end 26, thus eliminating the need for a leader 21. In this embodiment, while it is preferably that the sheet 20 be made out a stretchable material such as LYCRA®, it could be made out of a number of materials. The exchange member is preferably constructed of plastic, but can be made out a number of materials including, but not limited to, steel, extruded aluminum, or other materials. While the exchange member 24 as depicted in FIG. 5 is connected to the bottom end 26 using stitches 27, the exchange member 24 can be connected to the sheet 20 by any number of means, including, but not limited to, tape, rivets, staples, screws, or any other means.

Figure 6:
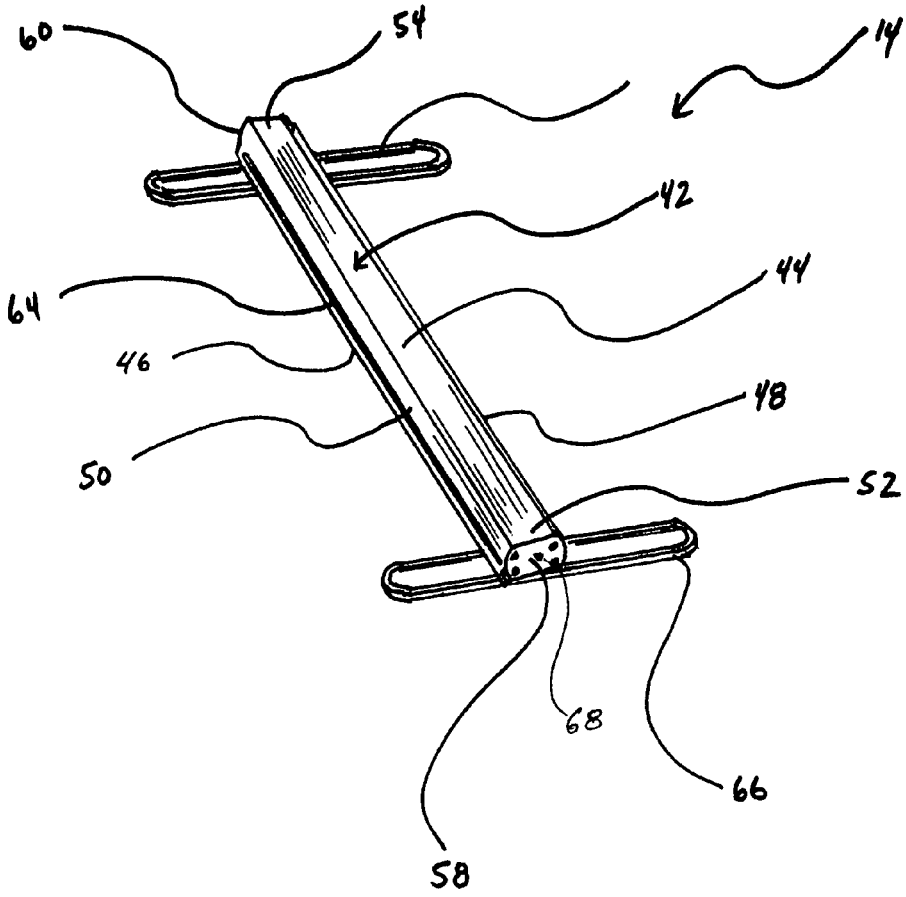
FIG. 6 is a is a rear perspective view of the base of a retractable banner stand according to an embodiment of the present invention.
Figure 7:
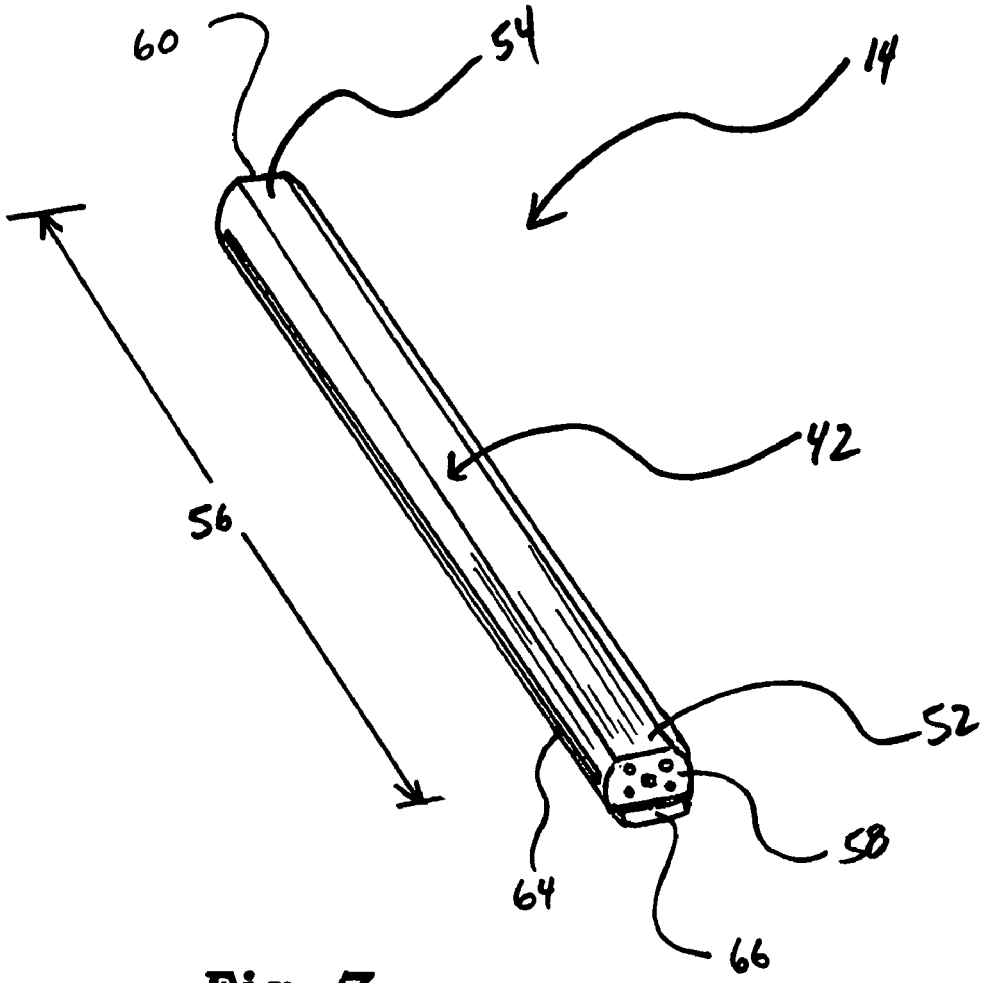
FIG. 7 is a is a front perspective view of the base of a retractable banner stand according to an embodiment of the present invention.
Figure 10:
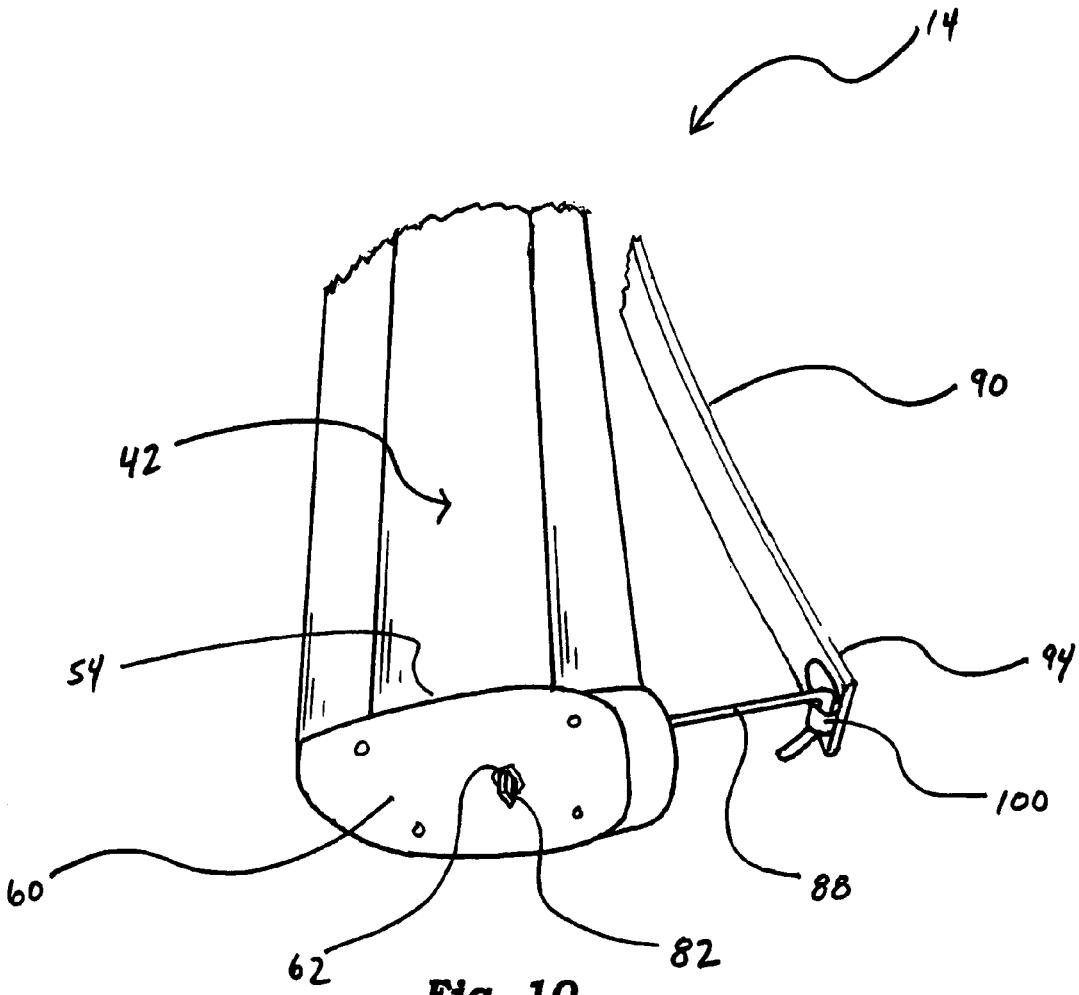
FIG. 10 is a side perspective view of the base of a retractable banner stand according to an embodiment of the present invention.

As depicted in FIGS. 6-7, the base 14 of the present invention preferably comprises a housing 42 comprising a top 44, a bottom 46, a front 48, and a rear 50. The housing 42 further comprises a first housing end 52 and a second housing end 54, the distance between the housing ends 52, 54 defining a housing width 56. The housing 42 is enclosed at the first housing end 52 by a first plate 58 and at the second housing end 54 by a second plate 60, the plates 58, 60 preferably being connected to the housing 42 using screws. Alternatively, the plates 58, 60 can be connected to the housing 42 using bolts, rivets, snaps, or weldaments. As can be seen in FIG. 10, the plates 58, 60 each preferably include a tab aperture 62. The housing 42 further preferably includes a banner slot 64 extending substantially from the first housing end 52 to the second housing end 54. The housing is preferably constructed of extruded aluminum, but can be made out a number of materials including, but not limited to, sheet metal or various polymers.

In a preferred embodiment of the present invention, the base 14 also preferably comprises at least one foot 66 for stabilizing the retractable banner stand 10. As depicted in FIG. 7, when the retractable banner stand 10 is not in use and in a fully retracted position, the at least one foot 66 is arranged so that it is substantially parallel the housing 42. Once the retractable banner stand 10 is in use and in a dispensed position, the at least one foot 66 is arranged so that it is substantially perpendicular the housing 42, as depicted in FIG. 6. In this position, the at least one foot 66 gives stability to the retractable banner stand 10. The feet 66 contact the floor surface or tabletop surface. Such feet may be removable or pivotal for folding up the base for transportation and storage. In another embodiment of the present invention, the at least one foot 66 is snapped, pivoted, or slid onto the ends 52, 54 of the housing 42.

Figure 8:
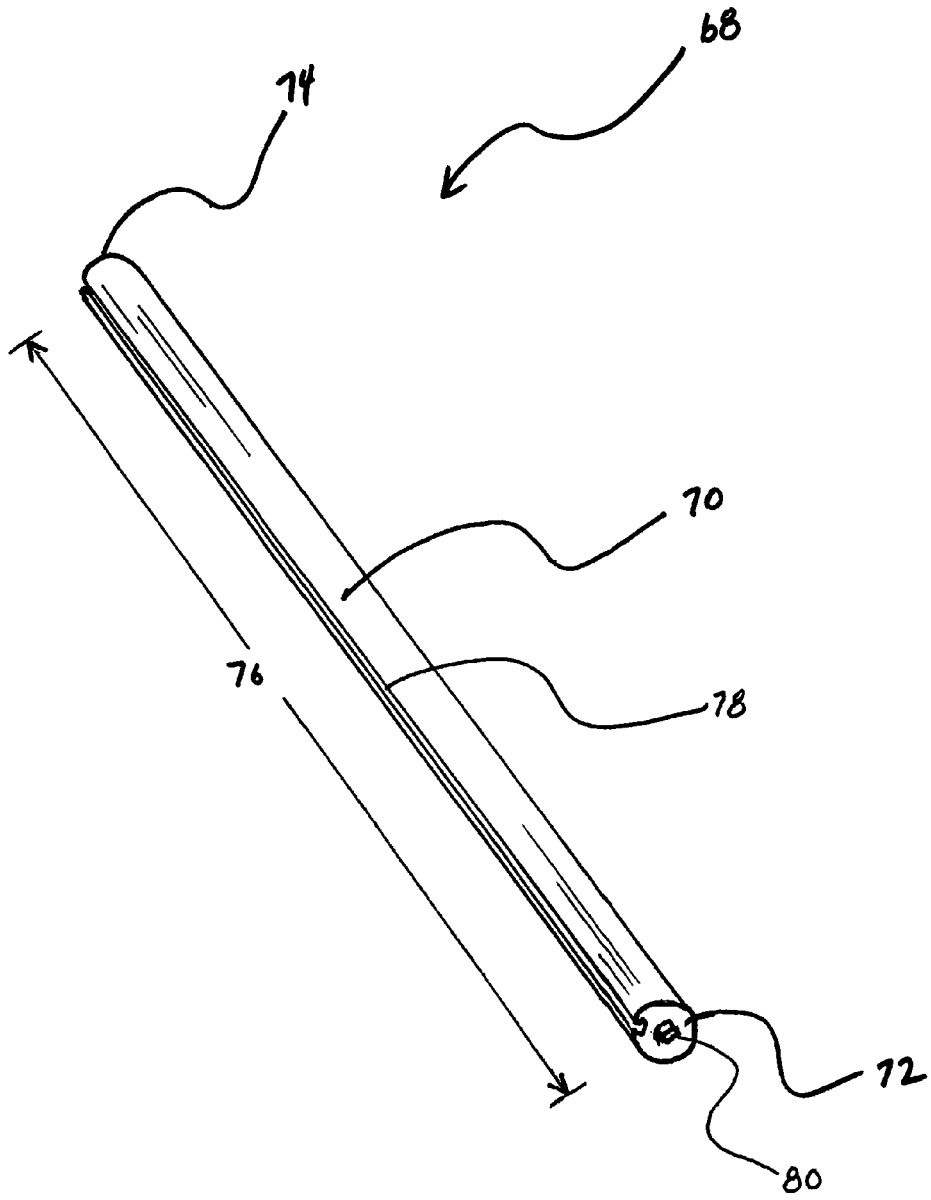
FIG. 8 is a is a perspective view of the retractor or core of a retractable banner stand according to an embodiment of the present invention.

The base 14 further comprises a retractor mechanism 68 as depicted in FIGS. 5 and 8. The retractor mechanism 68 preferably comprises a core 70, a first retractor end 72, and a second retractor end 74, the distance between the ends defining a retractor width 76. The retractor mechanism is preferably spring loaded and utilizes componentry not shown herein in detail but well known in the art. See, for example, U.S. Pat. No. 6,571,496 incorporated herein by reference. The retractor width 76 is preferably substantially equal to the housing width 56 and slightly larger than the banner width 22. The core 70 comprises a channel 78 preferably extending from the first retractor end 72 to the second retractor end 74. The retractor mechanism 68 also preferably comprises a first tab 80 extending beyond the first retractor end 72 and a second tab 82 extending beyond the second retractor end 74. The tabs 80, 82 are preferably slightly smaller in size than the tab aperture 62.

As depicted in FIG. 5, the leader 21 or sheet 20 may be connected to the retractor mechanism 68 by first slidably engaging the exchange member 24 with the channel 78. Once the exchange member 24 engages the channel 78, the sheet 20 can then be wound onto the core 70 creating a banner roll 84, which preferably has a round profile. The channel 78 preferably comprises a retaining feature (not depicted in the figures) to retain the exchange member 24 from slipping out of the core 70 when there is no load on the retractor 68. It is also contemplated that the bottom end 26 of the banner includes a leader 21 made of the sheet 20. The leader would slidably engage with the channel 78 in order to connect the banner 12 to the retractor 68 in an alternative manner.

In another embodiment, the leader 21 may be connected directly to the core 70. In this embodiment, the banner 12 comprises an exchange member 24 having a first exchange member portion and a second exchange member portion. The first exchange member portion is connected to the leader 21 opposite where the leader 21 is connected to the core 70. The second exchange member portion is connected to the sheet 20 opposite the header 28. When one using the retractable banner stand 10 desires to change the sheet 20, she simply slides apart the two exchange member portions and inserts a new sheet 20 having a second exchange member portion. Once sheet 20 has been rolled into the banner roll 84, the banner roll 84 can be placed through an access aperture 86 located on at least one of the first plate 58 or second plate 60 and positioned inside of the housing 42 until the first tab 80 slidably engages with the tab aperture 62 on the plate opposite the plate in which the access aperture 86 is located. Once the first retractor end 72 abuts the plate, the access aperture 86 is enclosed so that the second tab 82 is captured by the tab aperture 62 on the plate comprising the access aperture 86.

If at least one of the first plate 58 or second plate 60 does not include an access aperture 86, the housing 42 can include an access door (not depicted) on the top 44, bottom 46, front 48, or rear 50 in which the banner roll 84 can be inserted into the housing 42. When the banner roll 84 is placed into the housing 42, the sheet 20 is positioned such that header 28 is located outside of the housing 42 while the remainder of the banner roll 84 is located within the housing 42. By being larger than the banner slot 64, the top strip 32 preferably prevents the header 28 from being wound onto the banner roll 84 once the banner roll 84 is inserted into the housing 42. The retractor 68 preferably further comprises a winding mechanism (not depicted in the figures) for winding and unwinding the banner 12 with respect to the core 70. Such a winding mechanism is shown and described in PCT Application Publication No. WO 00/47508, and hereinafter incorporated by reference.

Because a retractable banner stand 10 according to the present invention includes an access aperture 86 or other access door, users can change the a banner 12 on a banner roll 84 without having to remove or move anything on the base 14, with the exception of the retractor 68. This allows users to quickly change any graphics on the retractable banner stand 10 if they need to do so.

When one desires to use the retractable banner stand 10, the post 18 and cross member 16 usually must be assembled and connected before the banner 12 can be dispensed. The post 18 is first connected to the housing 42 intermediate the first housing end 52 and second housing end 54 such that the post 18 is perpendicular the housing 42. The cross member 16 is then connected to the post 18 so that the cross member 16 is preferably perpendicular to the post 18 and substantially parallel to the housing 42. While the post 18 can be made of an integral, unitary section, it is contemplated that the post 18 comprise more than one section so that it may be adjusted in height and can be dissassembled. In addition, while it is preferable that the post 18 and cross member 16 be separate but connectable, it is contemplated that the post 18 and cross member 16 be connected using a pin or hinge (not depicted in figures). In this embodiment, once the post 18 is connected to the housing 42, the cross member 16 could be rotated or hinged so that it is perpendicular to the post 18. Once the post 18 and cross member 16 are assembled and connected, the banner 12 can be dispensed from the retractor 68 until the top strip 32 or header 28 can be connected to the cross member 16. The top strip 32 or header 28 can be connected to the cross member 16 using a hook, snap, magnetic strips, screws, bolts, slot & groove, or hook and loop material such as Velcro®.

Figure 9:
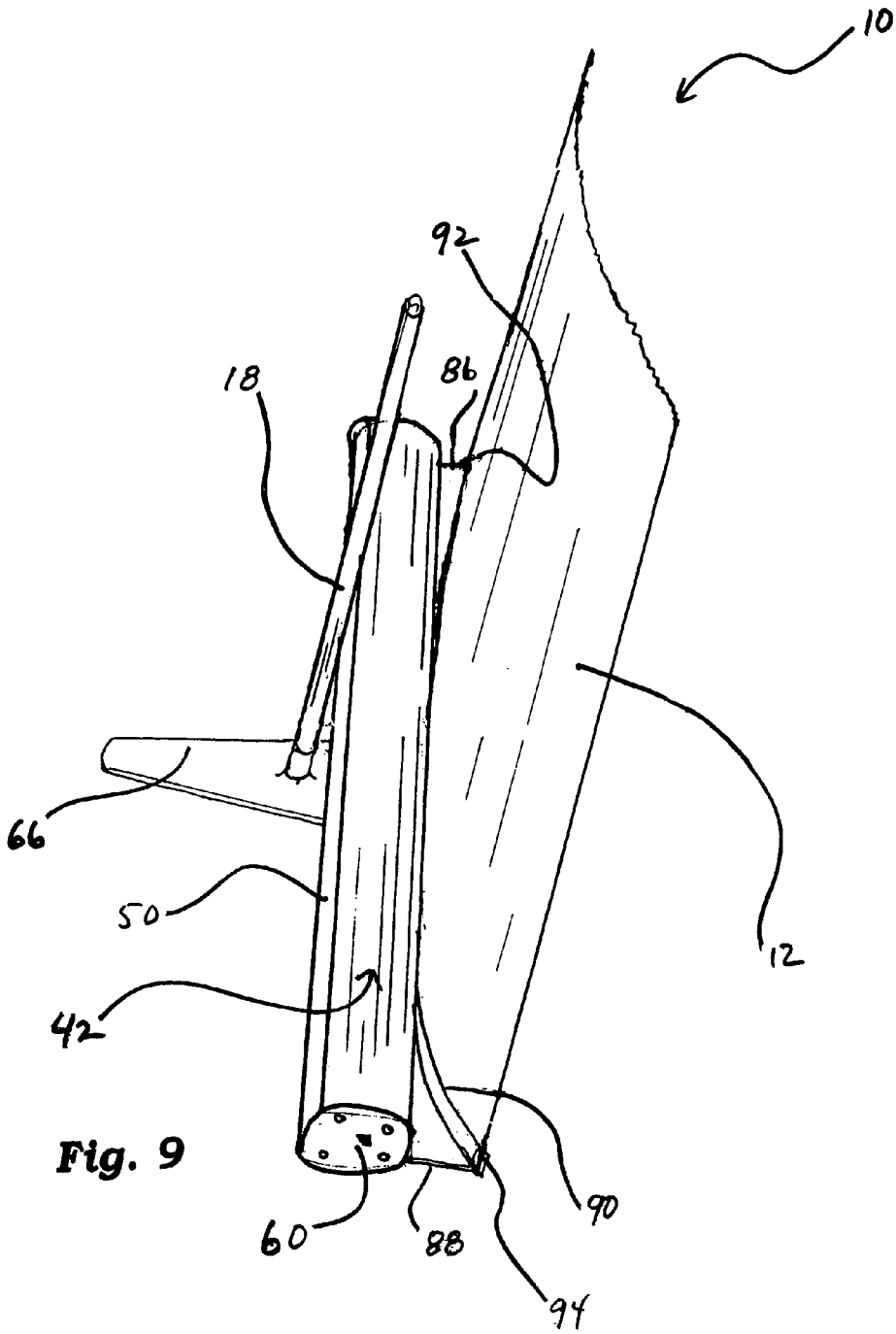
FIG. 9 is a rear perspective view of a retractable banner stand according to an embodiment of the present invention.
Figure 11:
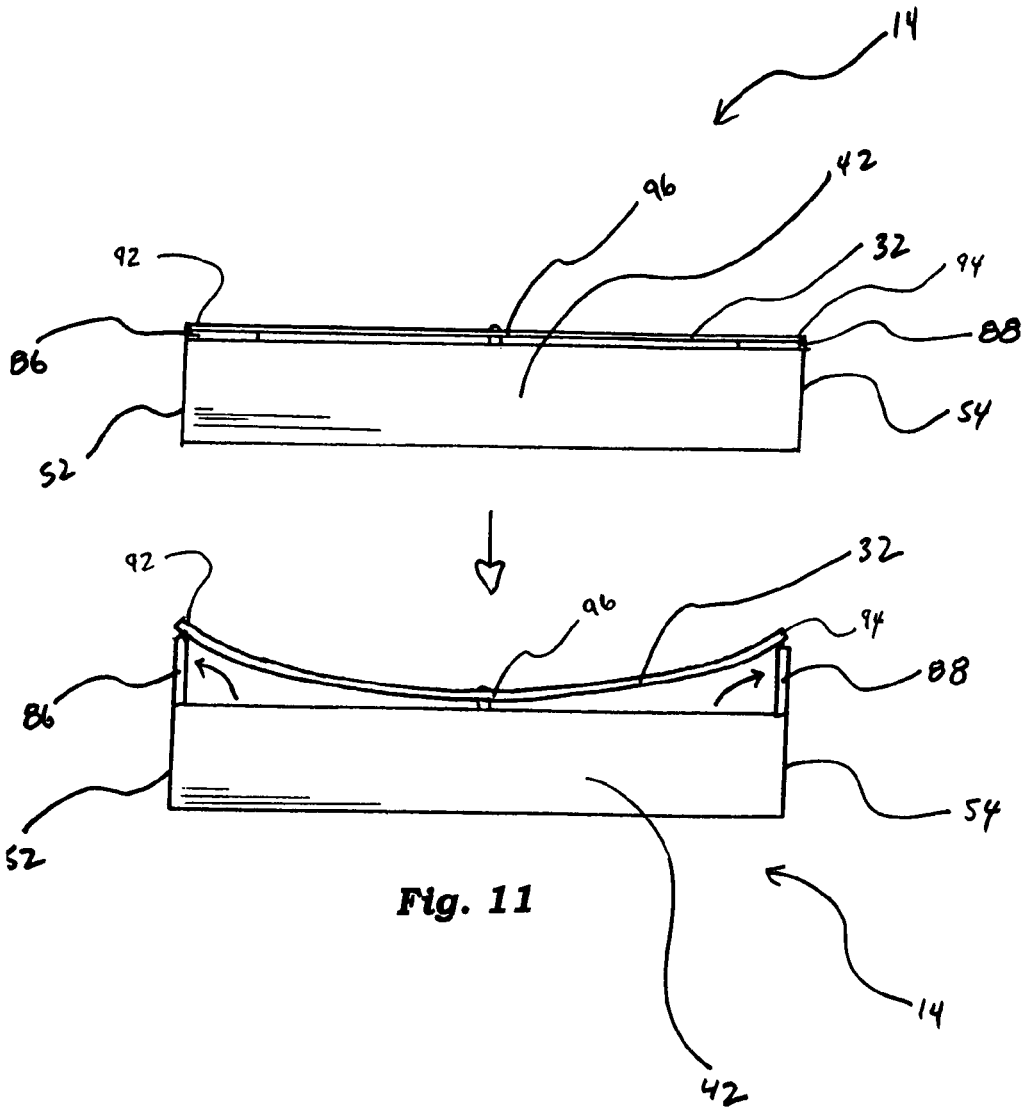
FIG. 11 is a top view of the base of a retractable banner stand according to an embodiment of the present invention depicting a means for providing curvature to the banner.

The retractable banner stand 10 of the present invention also comprises various curved forms and curvature means for providing curvature to the banner 12. In a first embodiment, as depicted in FIGS. 9-11, a retractable banner stand 10 comprises a first base spacer 86 hingedly connected to the housing 42 proximate the first housing end 52 and a second base spacer 88 hingedly connected to the housing 42 proximate the second housing end 54. Alternatively, the first base spacer 86 could be hingedly connected to the first plate 58 and the second base spacer 88 hingedly connected to the second plate 60. In this first embodiment, the base 14 also comprises a base strip 90 comprising a first strip end 92, second strip end 94, and base strip center 96. Also, in this embodiment, the base strip center 96 is preferably connected to the front 48 of the housing 42 intermediate the first plate 58 and second plate 60.

The base strip 90 preferably has a cross-section with a greater dimension in a first plane and a lesser dimension in a second plane that is perpendicular to the first plane. The greater dimension is preferably at least four times the lesser dimension whereby the base strip 90 is more readily flexible in the plane of the lesser dimension and wherein the plane of the lesser dimension is substantially horizontal when the retractable banner stand 12 is erected into the upright mode. While the base strip 90 has been described as having a greater dimension in a first plane and a lesser dimension in a second plane that is perpendicular to the first plane, in another embodiment the base strip could be a rod, cylinder, or wire.

When the banner 12 is in a fully retracted position, the base spacers 86, 88 are preferably folded inward towards a position intermediate the first housing end 52 and second housing end 54 so that the base spacers 86, 88 abut the housing 42. When the base spacers 86, 88 are in this position, the base strip 90 is in a non-use position and remains unstressed and is in a substantially unflexed shape.

When the banner 12 is in a fully dispensed position, as depicted in FIG. 9, the base spacers 86, 88 can be displaced hingedly outward to a position substantially perpendicular with the front of the housing 48. Once the base spacers 86, 88 are in this position, the first base spacer 86 engages a first eyelet 98 connected to the first base strip end 92 and the second base spacer 88 engages a second eyelet 100 connected to the second base strip end 94. Because the base strip center 96 is preferably connected to the housing 42, the base strip 90 is in a curved use position and is given a flexed, curved shape or form, as can be seen in FIG. 9. In another embodiment of the present invention, the base spacers 86, 88 could slide into a slot in the base housing 42 and then be connected to the slot in the base housing 42. In another embodiment of the present invention, the base spacers 86, 88 could hinge downwardly or upwardly to a position generally perpendicular with the front of the housing 48.

Figure 30:
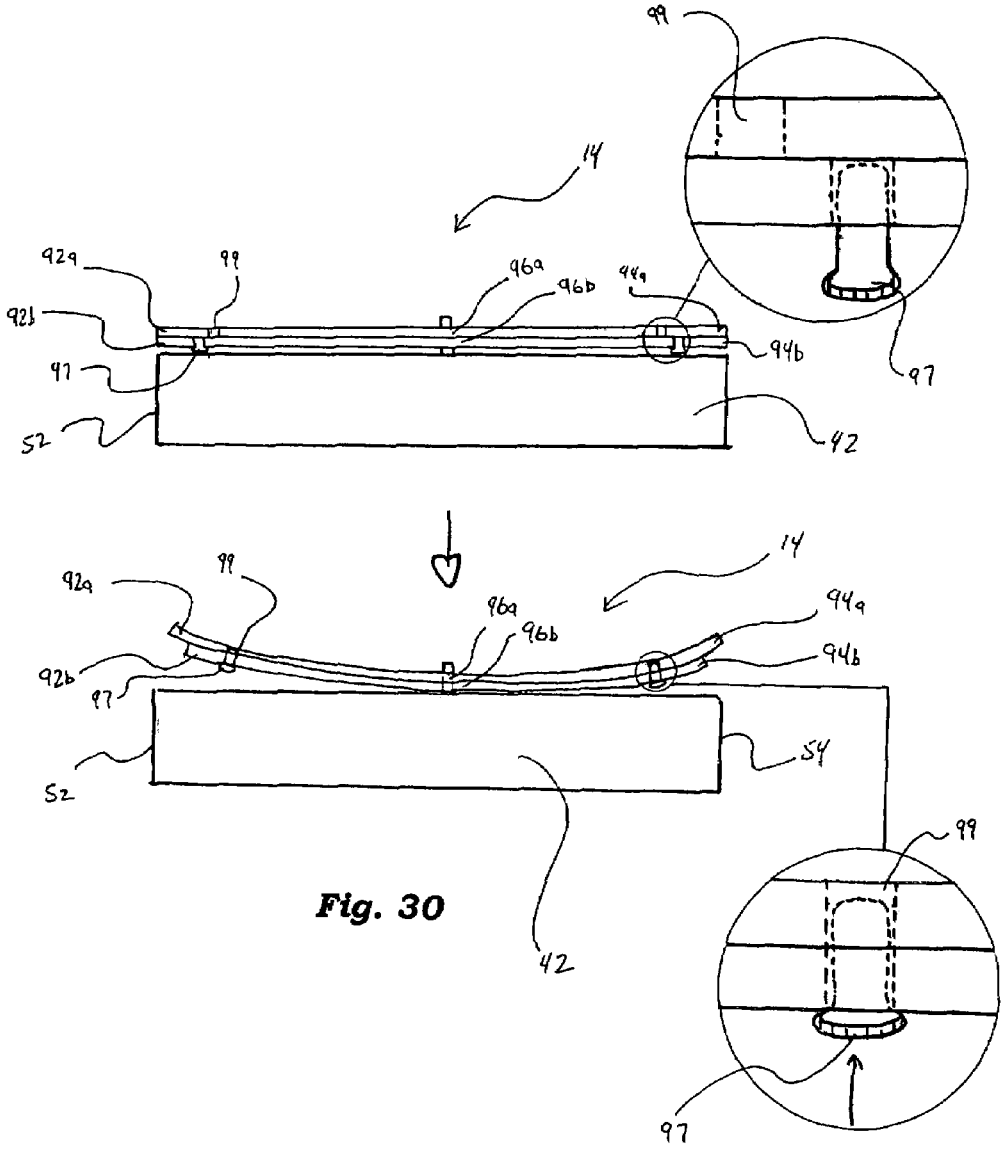
FIG. 30 is a top view of the base of a retractable banner stand according to an embodiment of the present invention depicting a means for providing curvature to the banner.

In another embodiment of the present invention, as depicted in FIG. 30, the means for imparting a curve on a banner is similar to a "leaf-spring" mechanism. In this embodiment, the base strip 92 comprises a first base strip member 92*a* and a second base strip member 92*b*. When the second base strip member 92*b* is given a flexed shape, it slides along and imparts a curve on the first base strip 92*a*. In order to retain the first base strip member 92*a* and second base strip member 92*b* in the flexed shape, the base strip 92 according to this embodiment further comprises tabs 97, preferably on the second base strip member 92*b*. Once the first and second base strips member 92*a*, 92*b* are given the flexed shape, the tabs 97 will engage with apertures 99 that are included on the first base strip member 92*a*. Alternatively, the tabs 97 could be included on the first base strip member 92*a* and the apertures 99 on the second base strip member 92*b*. When the tabs 97 engage with the apertures 99, the first and second base strip members 92*a*, 92*b* are retained in the flexed shape. To remove the first and second base strip members 92*a*, 92*b* from the flexed shape, the tabs 97 are disengaged with the apertures 99 so that the first and second base strip members 92*a*, 92*b* can return to an unflexed shape. The tabs 97 could include biasing means such as a spring so that they are biased towards the aperture 99 or could alternatively frictionally fit within the second base strip member 92*b* and manually slide into the aperture 99.

Figure 17:
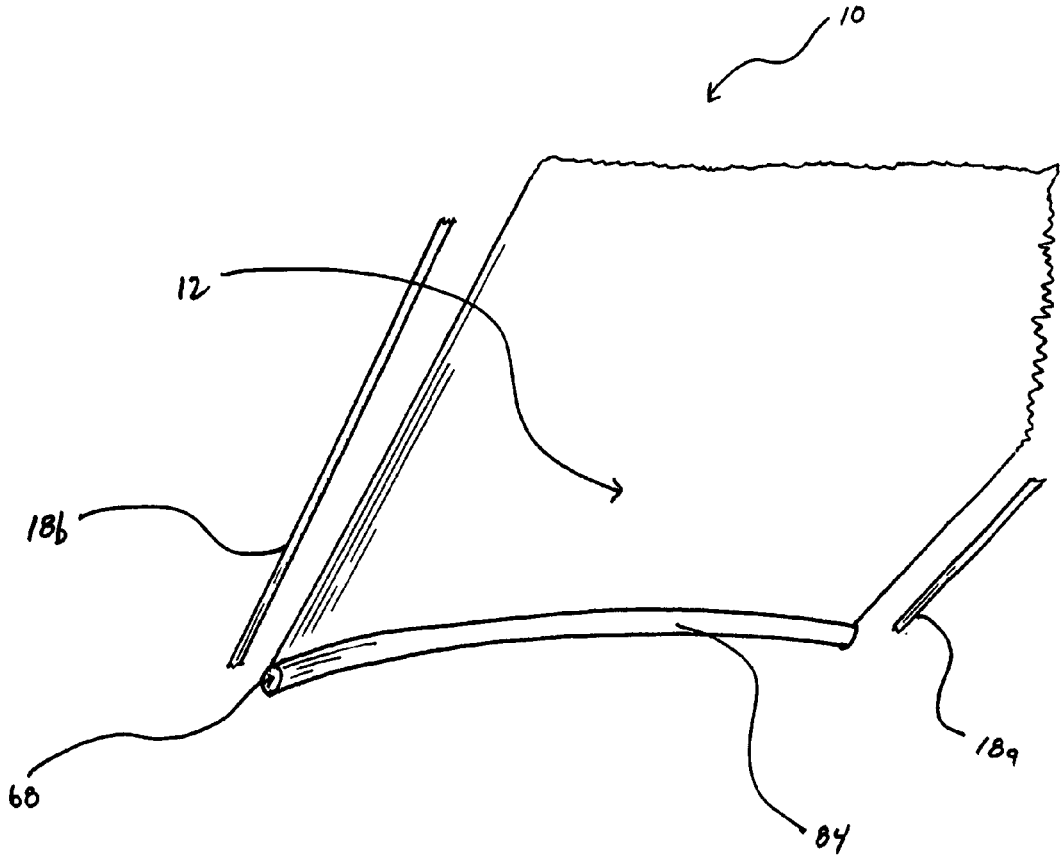
FIG. 17 is a front perspective view of a retractable banner stand according to an embodiment of the present invention.
Figure 27:
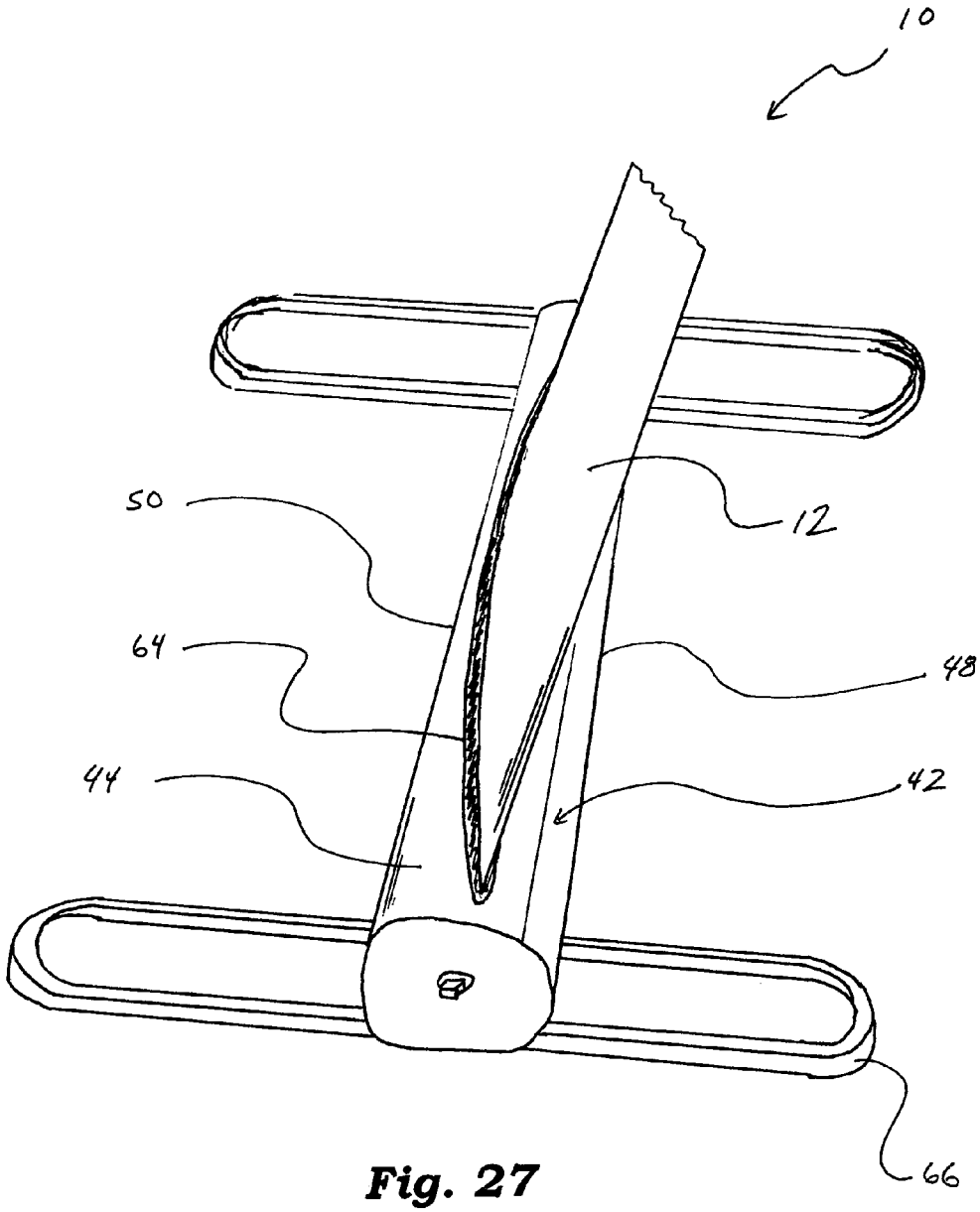
FIG. 27 is a side perspective view of a retractable banner stand according to an embodiment of the present invention.

As depicted in FIG. 27, in another embodiment of the present invention, the banner slot 64 is generally curved and is located on the top, front, or rear of the housing 42. When the banner 12 is retracted from the retractor mechanism 68, the slot 64 imparts a curve on the banner 12. In this embodiment, while it is preferred that the retractor mechanism 68 not be curved, it is contemplated that the retractor mechanism 68 be curved as depicted in FIG. 17.

Figure 12:
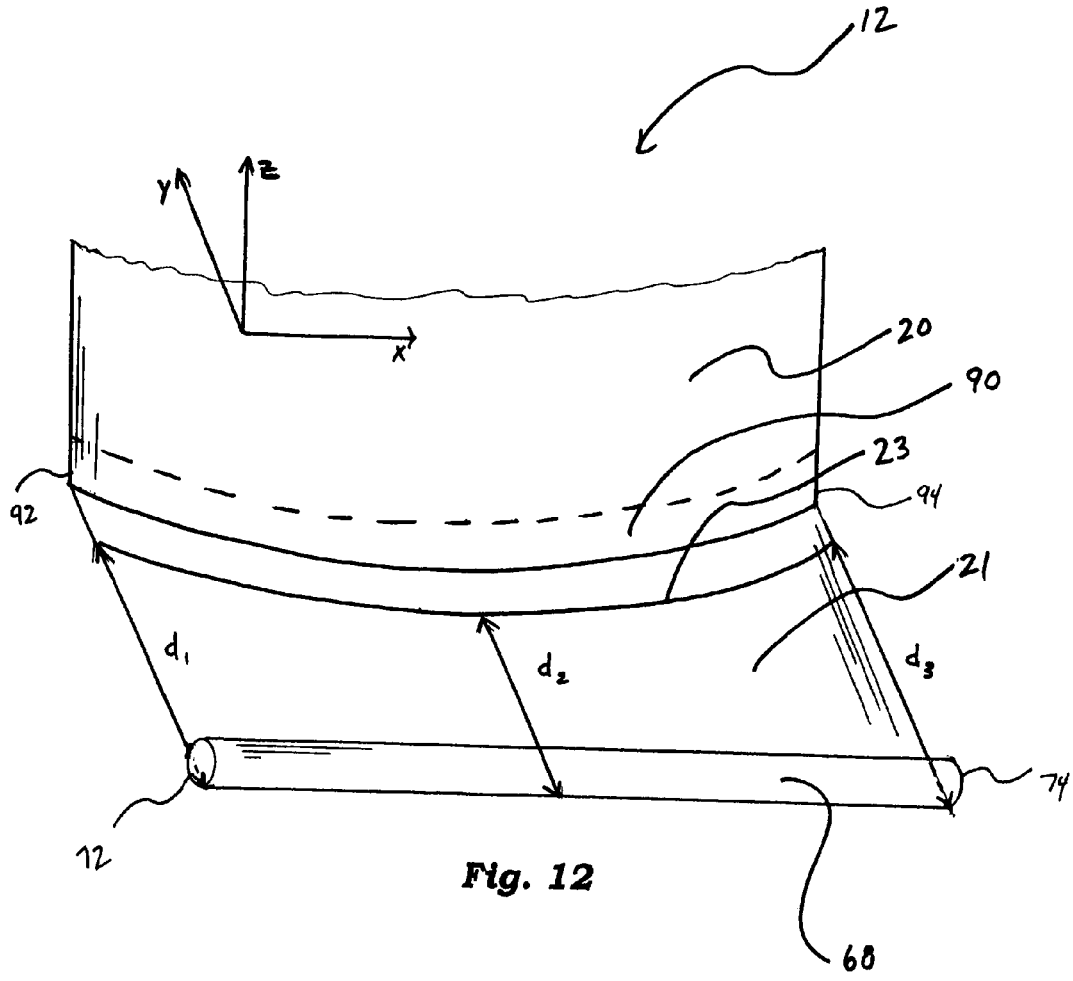
FIG. 12 is a rear perspective view of the banner of a retractable banner stand according to an embodiment of the present invention.
Figure 13:
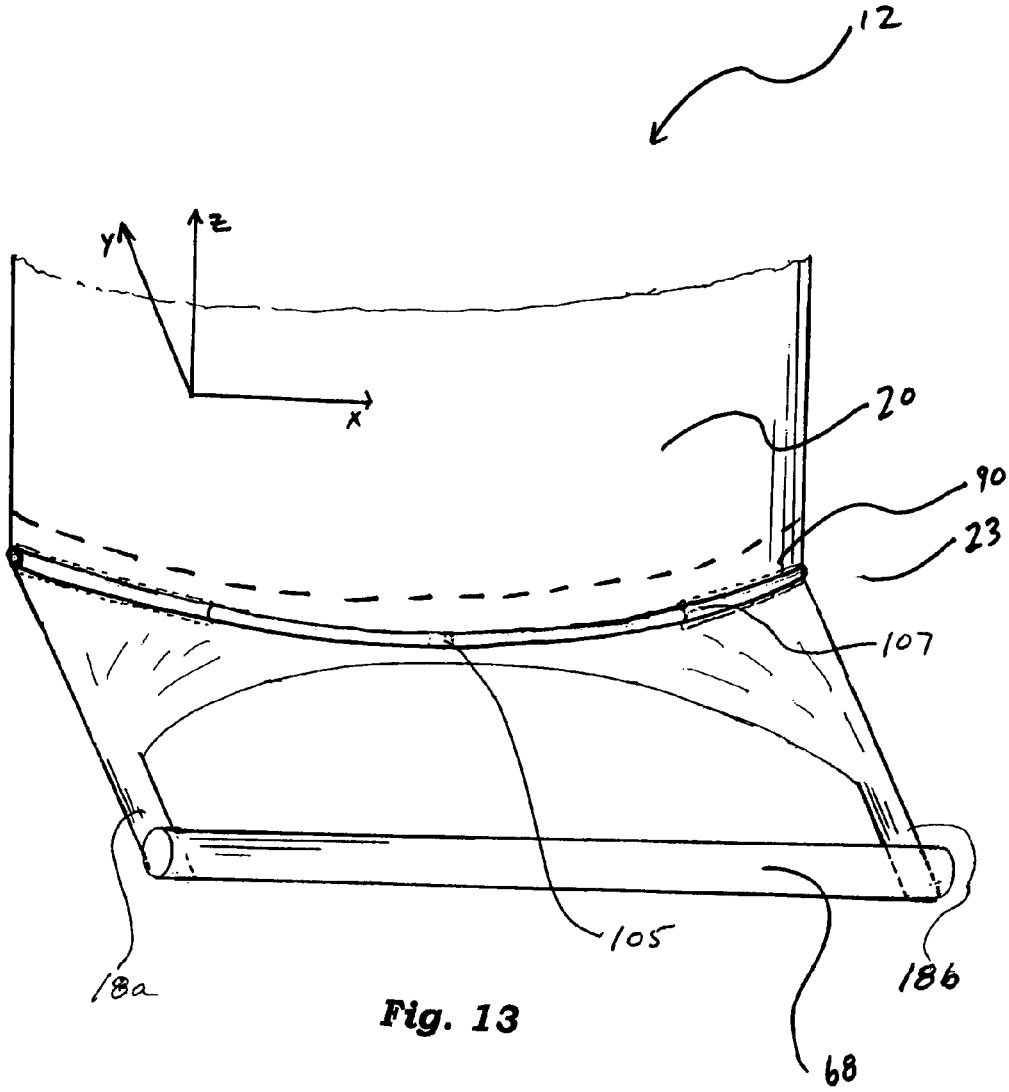
FIG. 13 is a rear perspective view of the banner of a retractable banner stand according to an embodiment of the present invention.

When it is given a flexed, curved shape, the base strip 90 then imparts a curve on the sheet 20. As depicted in FIGS. 12-13, which include x-y-z axes imposed on the figures, the stretchable leader 21 is stretched in different amounts about the z-axis, in the x-y plane, depending on the portion of the leader 21. For example, when the base strip 90 is given a flexed, curved shape, the leader material located between the first base strip end 92 and first retractor end 72 (labeled as d1), and the leader material located between the second base strip end 94 and the second retractor end 74 (labeled as d3) are stretched and stressed more along the y-axis direction than the leader material between the base strip center 96 and the retractor center 75 (labeled as d2). By using stretchable material to construct the leader 21, the leader 21 absorbs and deflection and stress created by the flexed, curved base strip 90 and the sheet 20 remains largely unaffected. This prevents the curved base strip 90 from creating any kinks or distortions on the sheet 20. Preferably the stretchable material extends across the entire width of the leader and for appropriate compensation of the stresses, the length of the leader material may appropriately be in a "concave" curve facing the erected banner as shown by the junction 23 between the graphic display portion of the banner and the leader portion. Alternatively, as depicted in FIG. 13, the leader 21 could comprise a two leader portions, 18*a*, 18*b*. In certain of such embodiments, it is may not be necessary to construct the leader portions using a stretchable material, although it would still be preferable. In another embodiment of the present invention, the sheet 20 could be constructed using a stretchable material. In this embodiment, it may not be necessary to include a leader 18.

As illustrated in FIG. 12, the flexible base strip may be permanently within the banner, such as by being sewn in or laminated therein. In such a case, it would be wound up on the core when the banner is retracted. FIG. 13 shows an alternative resiliently flexible rod 105 instead of the flexible strip, placed in a pair of pockets 107 in the banner. Such pockets can be configured to impart a stress to an otherwise straight rod to provide a curvature. For example, the distance between in inside ends of the pair of pockets may be less than the length of the unflexed rod, whereby placement of the rod in the pockets imparts the curvature to the rod. Such a resiliently flexible rod may also be used at the top of the banner for providing curvature there.

As depicted in FIG. 6, the retractable banner stand 10 according to this first embodiment also comprises a first header spacer 102 hingedly connected to a first mast end 104 and a second header spacer 106 hingedly connected to a second mast end 108. When the banner 12 is in a fully retracted position, the spacers 102, 106 are preferably folded inward towards a position intermediate the first mast end 104 and second mast end 108 so that the header spacers 102, 106 abut the cross member 16. When the header spacers 102, 106 are in this position, the top strip 32 remains unstressed and is in a substantially unflexed position.

Figure 14:
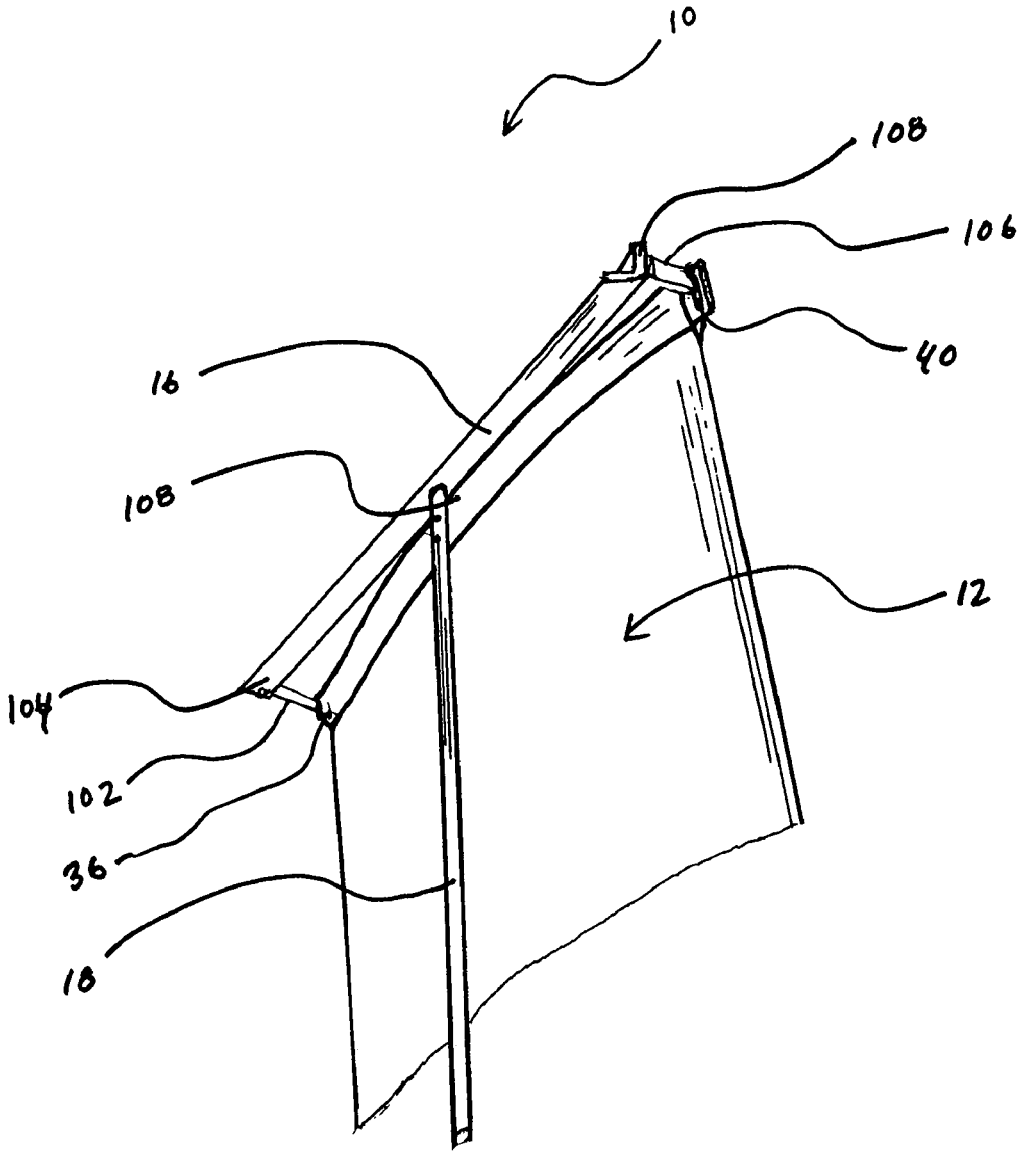
FIG. 14 is a rear perspective view of a retractable banner stand according to an embodiment of the present invention.

When the banner 12 is in a fully dispensed position, a header center 39 is connected to a mast center 109 using a hook, snap, rivet, or similar means. In order to connect the header center 39 to the mast center 109, there is preferably a cutout in the pocket (not depicted in the figures) providing access to the header center 39. In addition, once the top strip 32 is connected to the cross member 16, the header spacers 102, 106 can be hinged outward so that they are perpendicular with the cross member 16. Once the header spacers 102, 106 are in this position, the first header spacer 102 engages a third eyelet 36 located on the first header end 34 and the second base spacer 106 engages an fourth eyelet 40 located on the second header end 38. Because the header center 39 is first preferably connected to the mast center 109, the top strip 32 is then in given a flexed, curved shape or form, as can be seen in FIG. 14.

The top strip 32 preferably has a cross-section with a greater dimension in a first plane and a lesser dimension in a second plane that is perpendicular to the first plane. The greater dimension is preferably at least four times the lesser dimension whereby the top strip 32 is more readily flexible in the plane of the lesser dimension and wherein the plane of the lesser dimension is substantially horizontal when the retractable banner stand 12 is erected into the upright mode. While the top strip 32 has been described as having a greater dimension in a first plane and a lesser dimension in a second plane that is perpendicular to the first plane, in another embodiment the base strip could be a rod, cylinder, or wire.

The cross member can be a rigid form and have the curvature means accomplished by simply utilizing a curved cross member and suitably attaching the top of the banner thereto.

Figure 15:
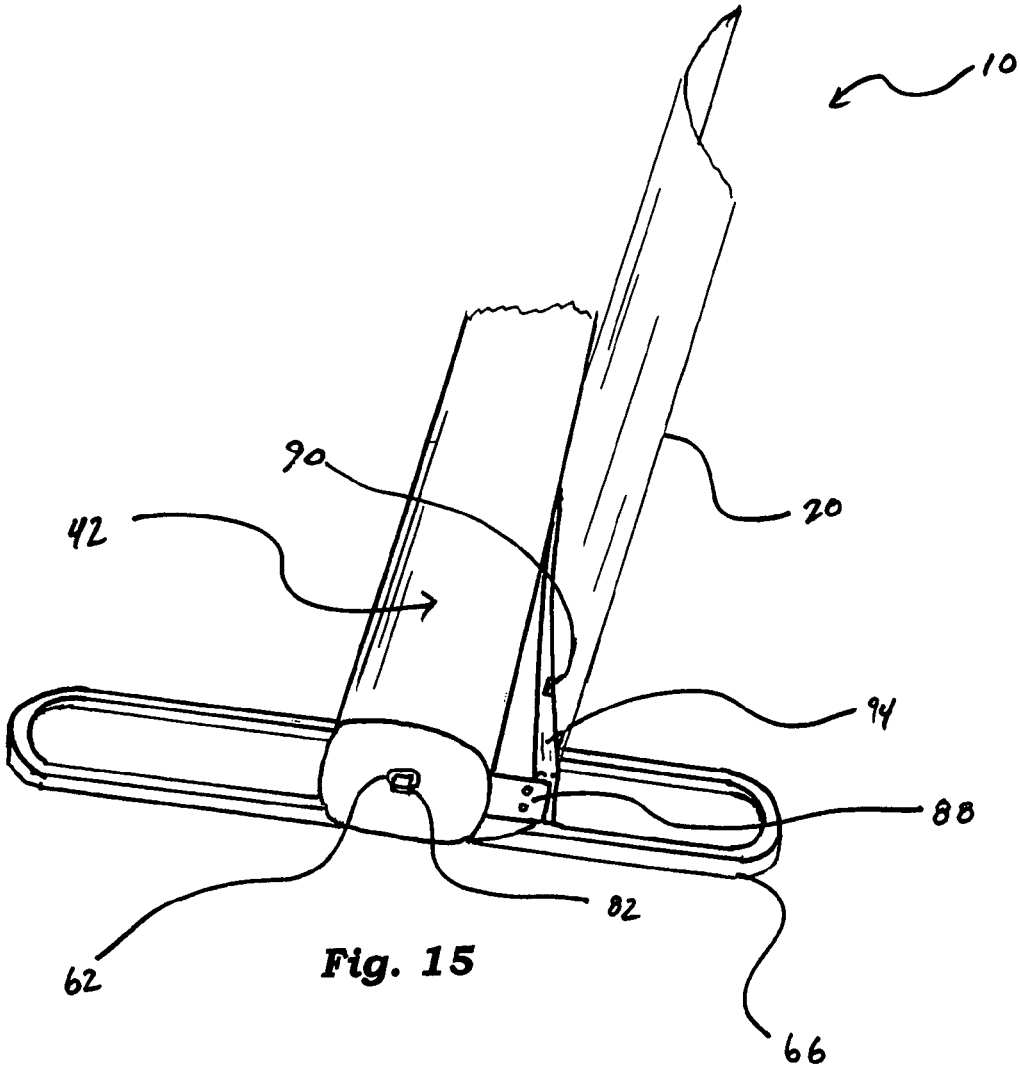
FIG. 15 is a side perspective view of the base of a retractable banner stand according to an embodiment of the present invention.
Figure 16:
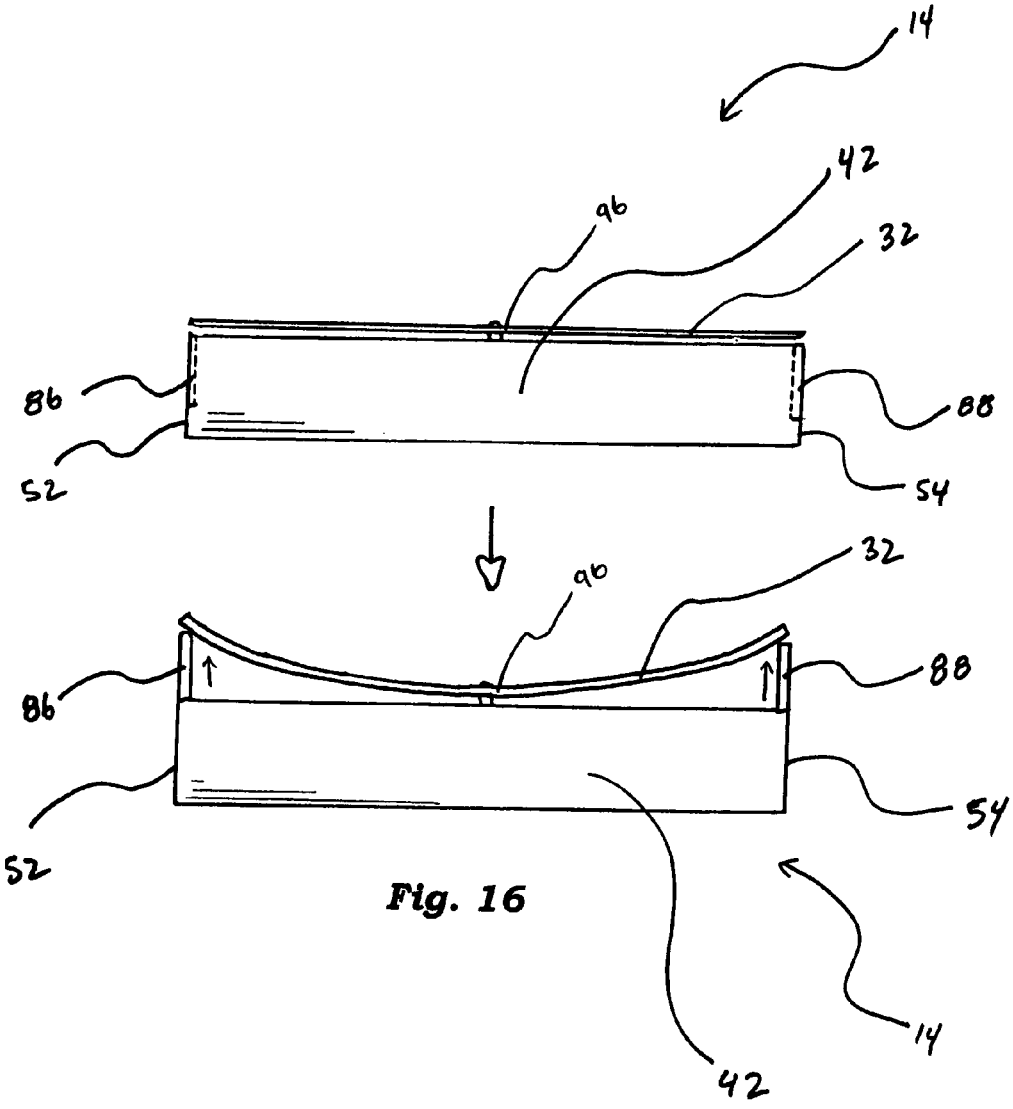
FIG. 16 is a top view of the base of a retractable banner stand according to an embodiment of the present invention depicting a means for providing curvature to the banner.

In a second embodiment of the present invention, as depicted in FIG. 15, the base spacers 86, 88 are slidably connected to the housing 42 and fixedly connected to the base strip ends 92, 94. In this embodiment, the base spacers 86, 88 are retained within the housing 42 or plates 58, 60 when a user does not wish in impart curvature to the banner 12 or while a user is dispensing the banner 12 from the retractor. When a user desires to impart curvature to the banner 12, the base spacers 86, 88 are released from the retained position and slid out into an extended position. The base spacers 86, 88 can then be locked in their extended position. Once the base spacers 86, 88 are in their extended positions, because the base strip center 96 is preferably connected to the housing 42, the base strip 90 is given in a flexed, curved shape, as can be seen in FIGS. 15 and 16.

In another embodiment of the present invention, as depicted in FIG. 17, the core 70 is made of a flexible material such that the retractor 68 can be flexed. Once the banner 12 is in a dispensed position, or while the banner 12 is being dispensed, the retractor 68 is flexed such that it imparts curvature to the banner 12. The banner 12 in this embodiment would not likely require the use of a leader 21. Because the entire retractor width 76 and banner width 22 are being curved, there would not be a significant amount of distortion due to the curvature. However, the banner 20 could be constructed of a stretchable material to compensate for any amounts of stress or distortion on the banner 12.

Figure 18:
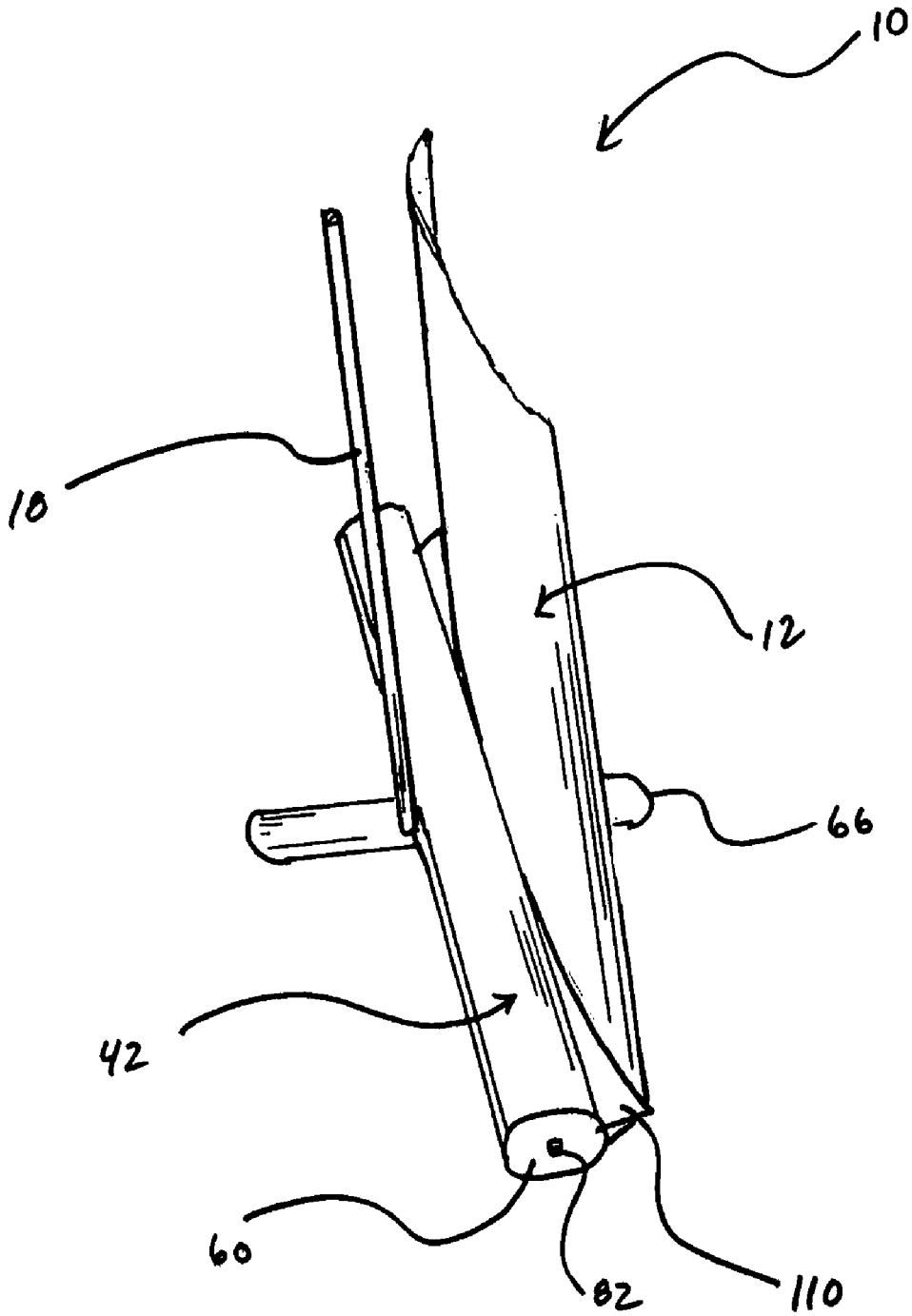
FIG. 18 is a side perspective view of a retractable banner stand according to an embodiment of the present invention.
Figure 19:
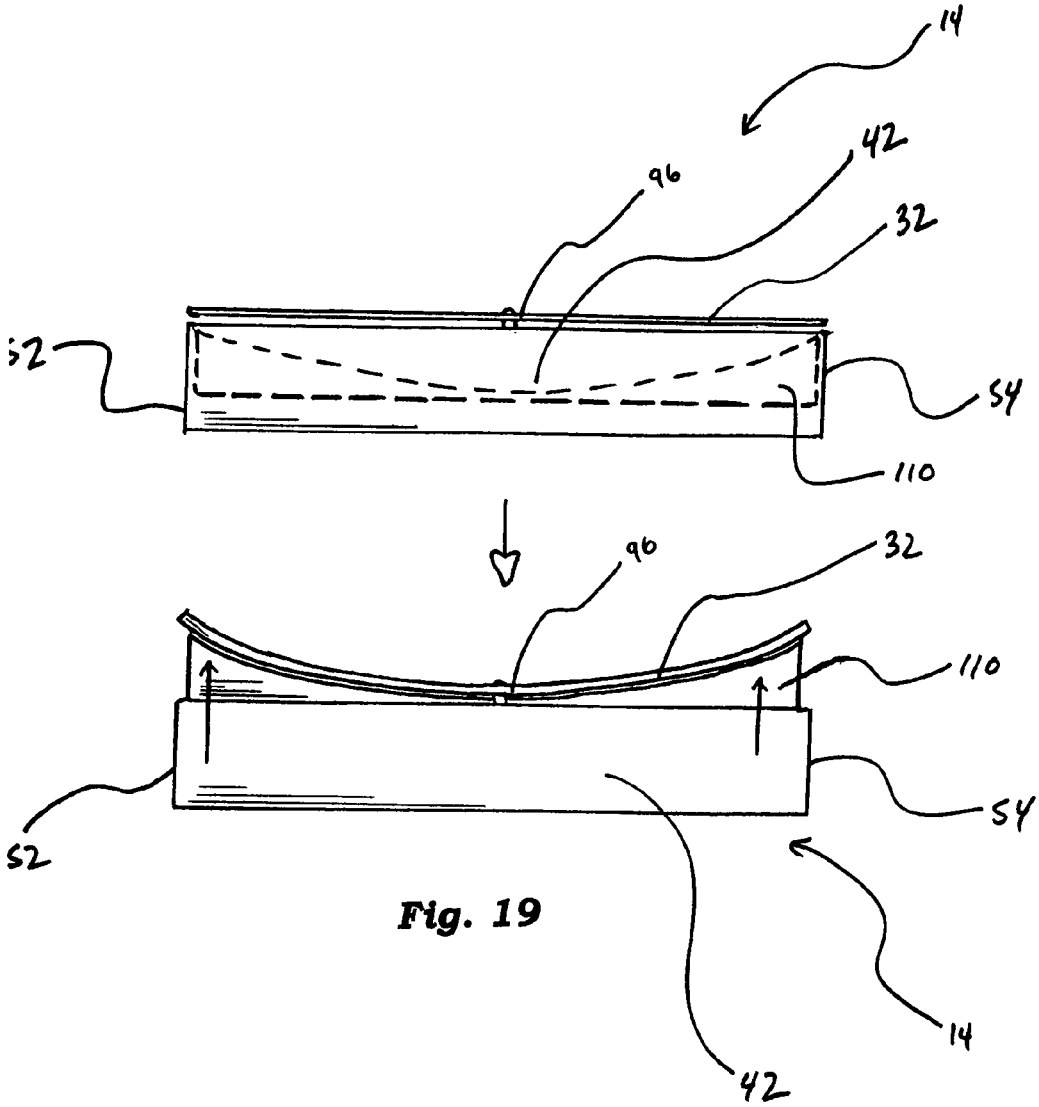
FIG. 19 is a top view of the base of a retractable banner stand according to an embodiment of the present invention depicting a means for providing curvature to the banner.
Figure 20:
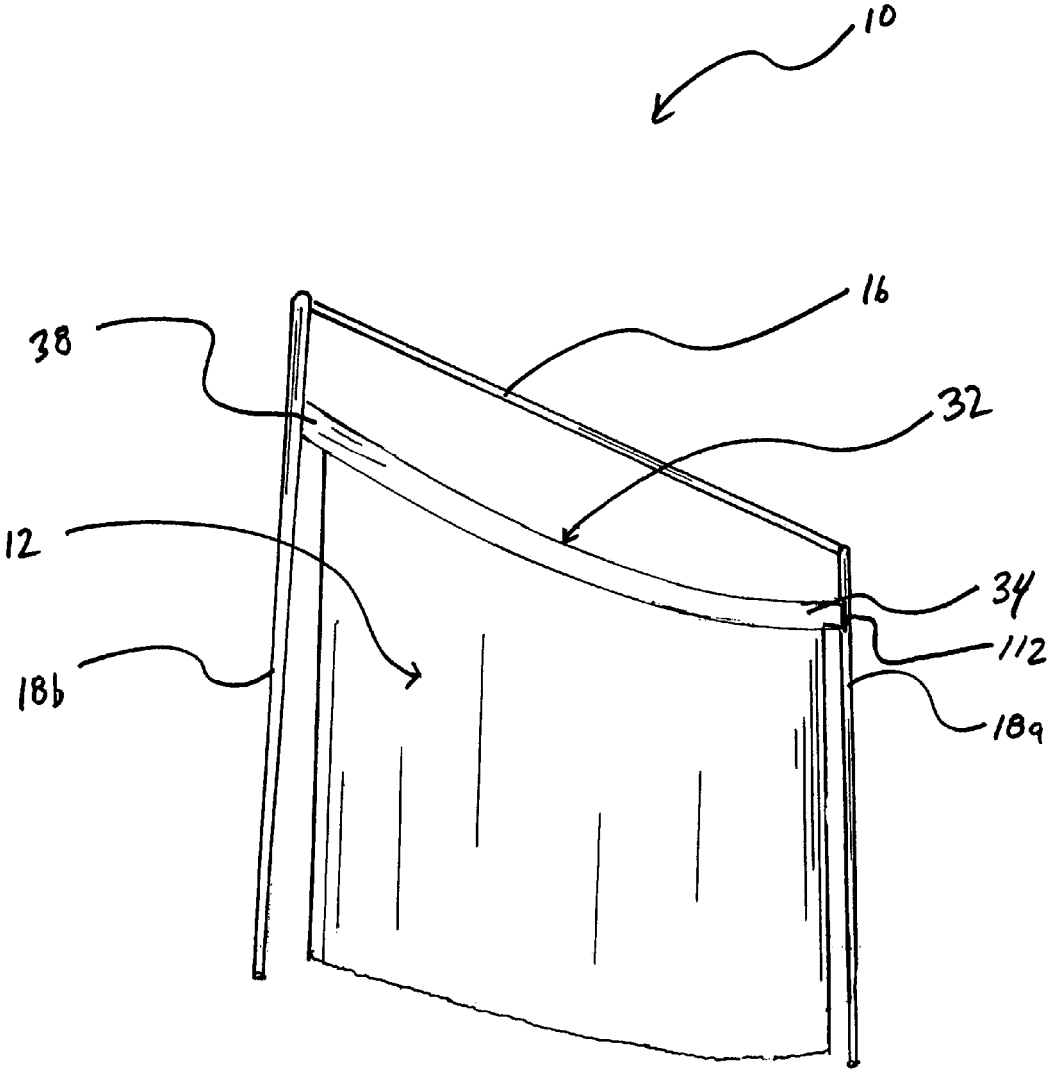
FIG. 20 is a front perspective view of the banner of a retractable banner stand according to an embodiment of the present invention.

In another embodiment of the present invention, as depicted in FIGS. 18-19, a base form 110 is slidably connected within the housing 42. Once the banner 12 has been dispensed from the retractor 68, the base form 110 can slide out of the housing 42. Once the base form has slid out of the housing, the general shape of the base form 110 is imparted on the banner 12 as it takes the general shape of the base form 110. For example, if the base form 110 has a curved shape, the banner 12 will take a generally curved shape. Alternatively, the base form 110 could be hinged or folded up against the housing 42 until the banner 12 is dispensed from the retractor 68. Once the banner 12 is fully dispensed, the base form 110 could be folded downwardly or upwardly so that it is substantially perpendicular with the housing 42. Once in this position, the general shape of the base form 110 would be imparted on the banner 12 as it takes the general shape of the base form 110.

In any of the aforementioned embodiments, the top strip 32 could be connected on the outside of the header 28, as opposed to being slidably engaged within a pocket 30 as described in the aforementioned embodiments. In this embodiment, once the banner 12 is dispensed from the retractor 68, the first header end 34 and second header end 38 could slidably engage post slots 112 on a first post 18*a* and a second post 18*b*, the posts 18*a*, 18*b* being connected to the base 14 and cross member 16. Before the ends header ends 34, 38 can be inserted into the post slots 112, a user would impart a curve to the top strip 32 so that the distance between the header ends 34, 38 would be slightly less than the distance between the posts 18*a*, 18*b*. Once the distance between the header ends 34, 38 is slightly less than the distance between the posts 18*a*, 18*b*, the header ends 34, 38 could be inserted into the post slots 112. By doing this, the posts 18*a*, 18*b* would retain the curvature in the top strip 32 once the header ends 34, 38 are retained.

Figure 21:
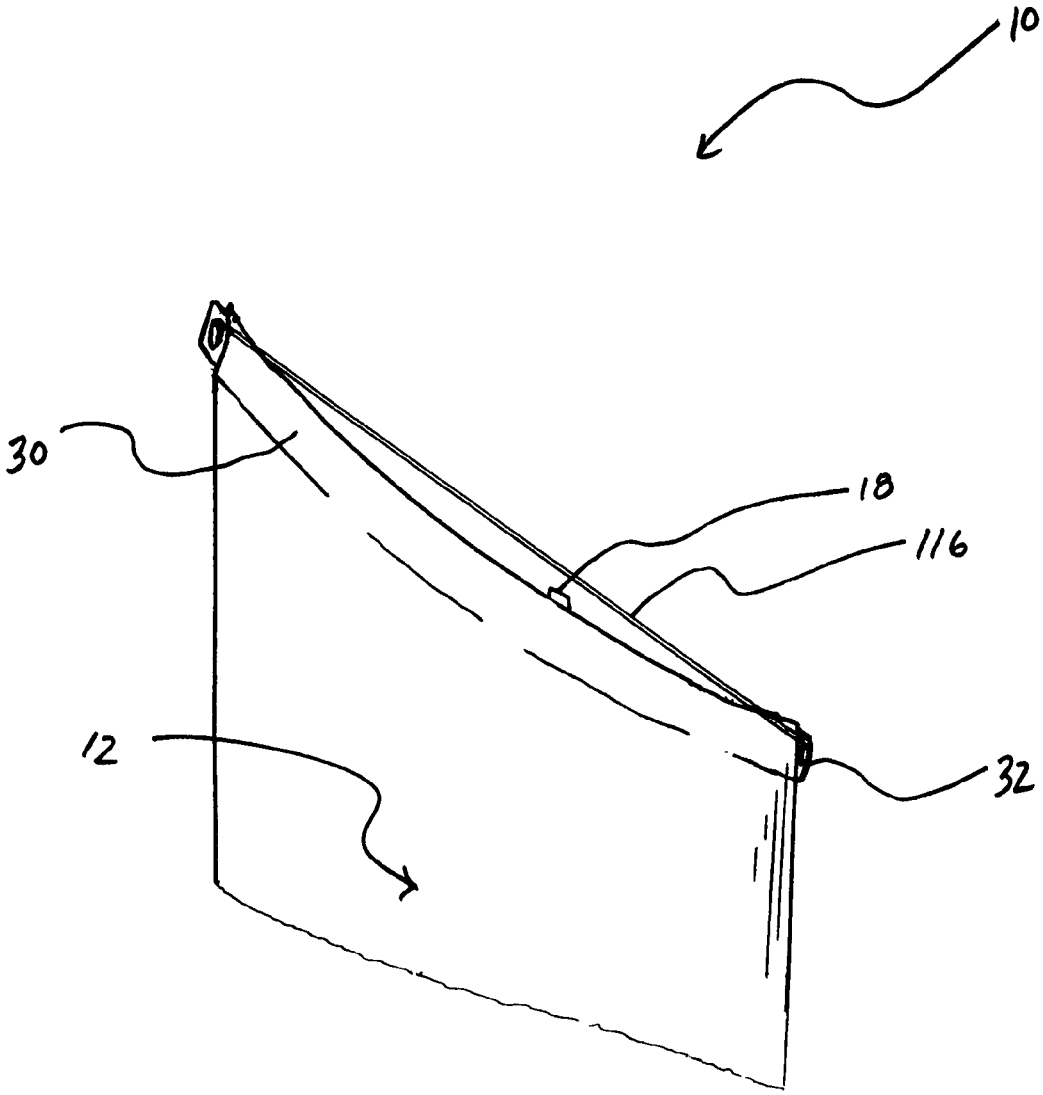
FIG. 21 is a front perspective view of the banner of a retractable banner stand according to an embodiment of the present invention.

In another embodiment of the present invention, as depicted in FIG. 21, the banner 12 could include a wire 116 connected to the top strip 32. Before the wire 116 is connected to the top strip, the top strip is flexed imparting a curve or bend in the top strip and then the wire 116 is connected to the first header end 34 and second header end 38, thus preserving the curve in the top strip 32. In this embodiment, once the banner 12 has been dispensed from the retractor 68, the header 28 or top strip 32 of the banner 12 can be connected to the mast center 109 using a hook, snap, rivet, Other suitable means.

Figure 22:
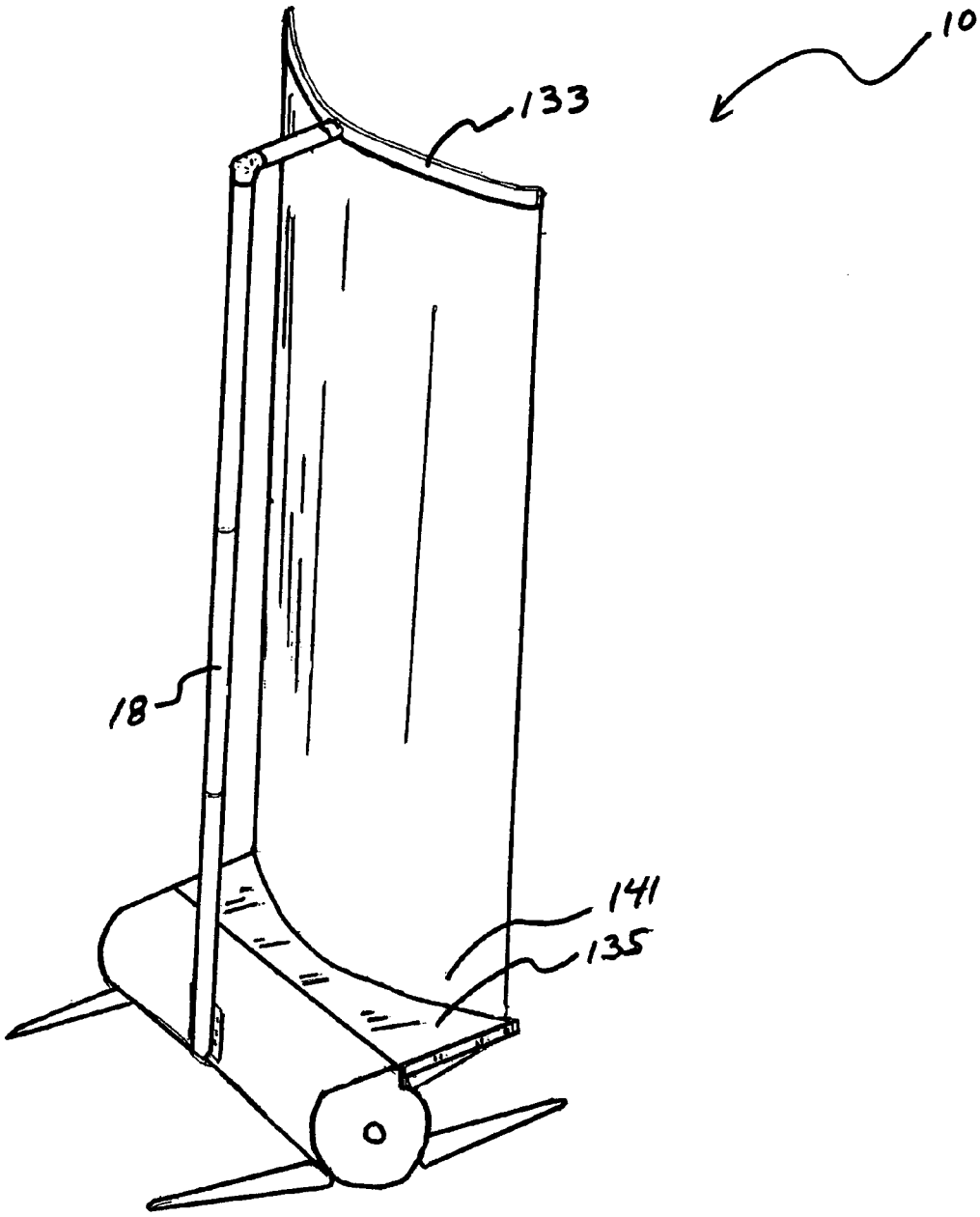
FIG. 22 is a rear perspective view of an embodiment utilizing rigid curvature means at the top and bottom of the banner.

Referring to FIG. 22, another embodiment in which the means for providing curvature to the banner comprises rigid curved form 133 configured as the cross bar and a rigid lower curved form 135. Both of these components, as well as the mast 18 are preferably separable from the other components and/or dissassembleable. In this embodiment, the top 137 of the banner may be connected using attachment means 139 such as hook and loop material, magnetic strips, snaps, hooks or other known attachment mechanisms. The bottom 141 of the banner remains attached to the retractor mechanism as in the other embodiments but may also be suitably secured to the lower curved form such as by magnetic strips or hook and loop material. Stretchable leader material may also be used in this embodiment. The leader material is preferably more stretchable that the material utilized for the banner.

Figure 25:
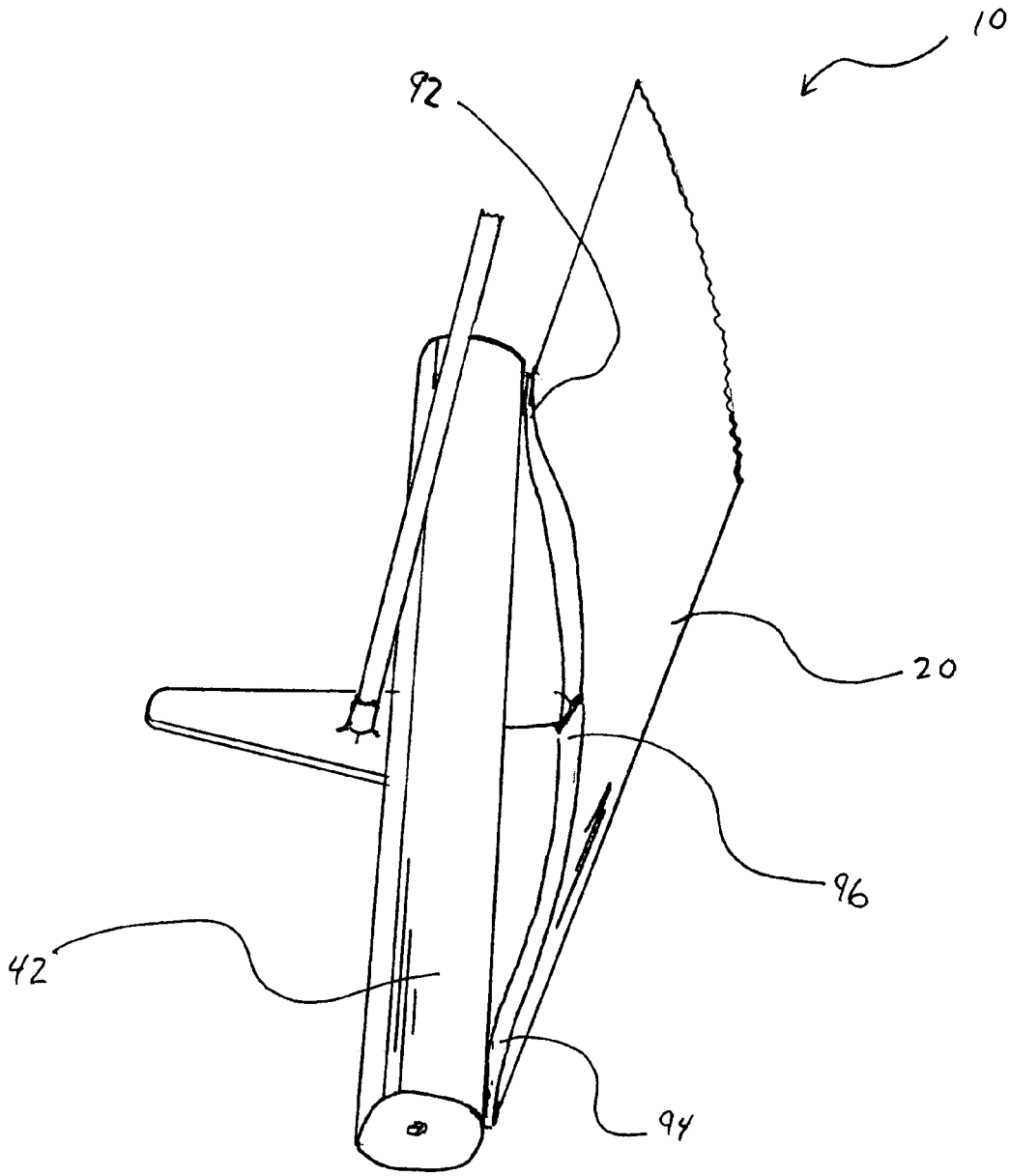
FIG. 25 is a side perspective view of a retractable banner stand according to an embodiment of the present invention.
Figure 26:
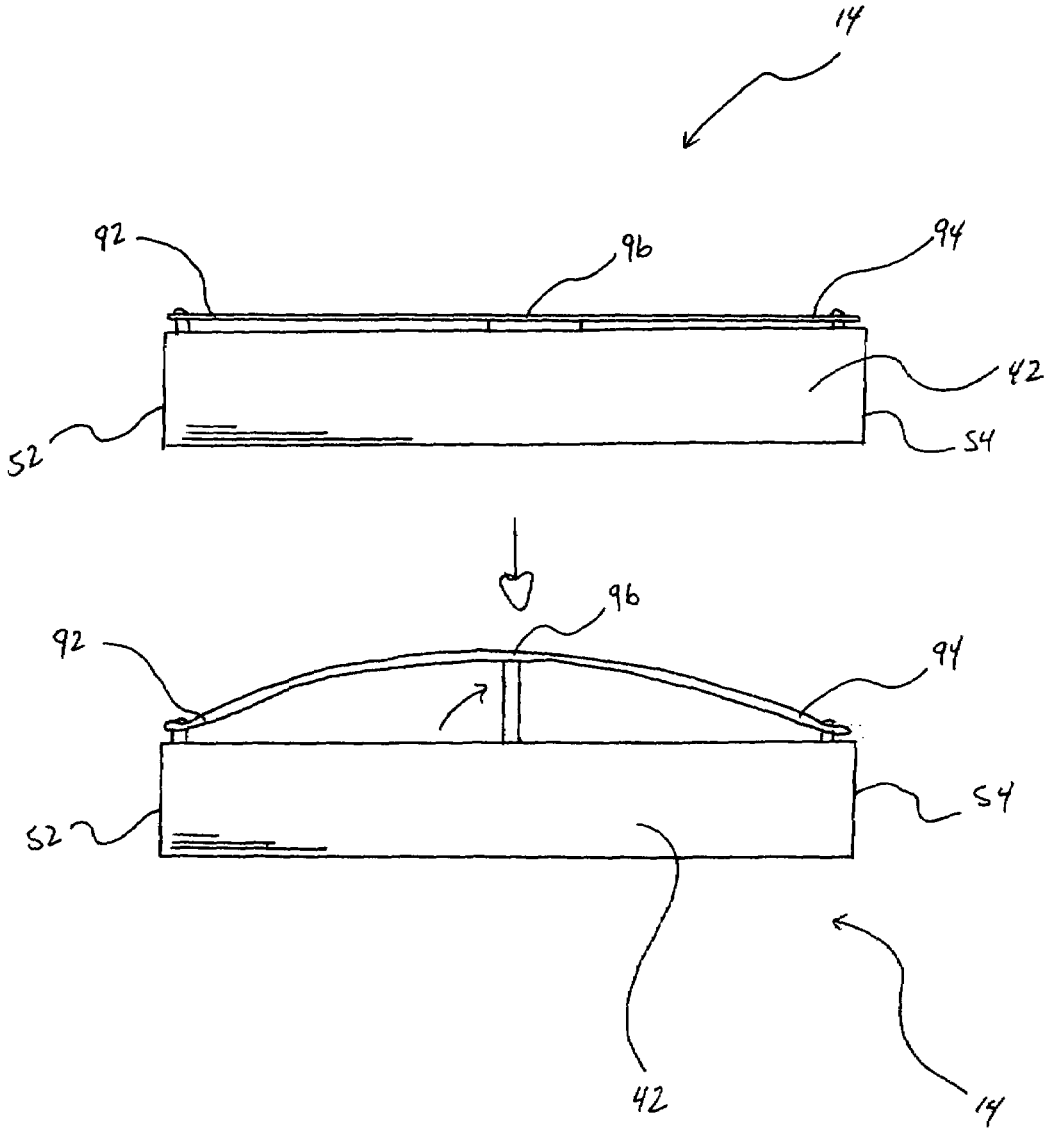
FIG. 26 is a top view of the base of a retractable banner stand according to an embodiment of the present invention depicting a means for providing curvature to the banner.

The various embodiments of the retractable banner stand have been described as having a generally concave shape when viewing the banner from the front. Those of ordinary skill in the art would appreciate that the various embodiments of the present invention could be easily modified so that the retractable banner stand has a generally convex shape when viewing the banner from the front. An example of such a banner can be seen in FIGS. 25-26. In this embodiment, the first strip end 92 and second strip end 94 of the base strip 90 could be connected to the front 48 of the housing 42 while the base strip center 96 remains unconnected. Any number of means, including those described in the present application, could be used to impart a curve on the base strip 90 according to this embodiment.

Figure 23:
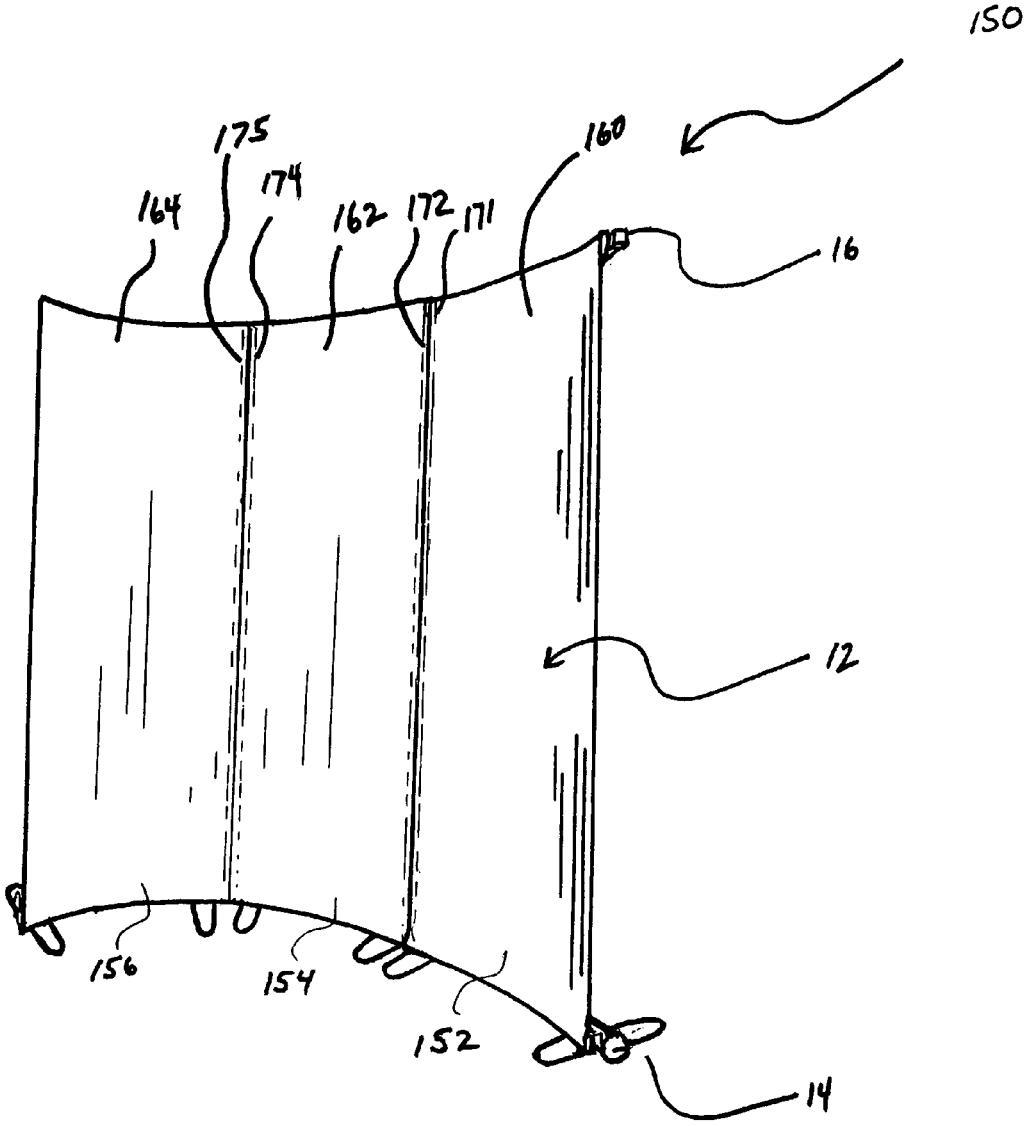
FIG. 23 is a perspective view of an embodiment of the invention using a plurality of retractable banner stands.

Referring to FIG. 23 another embodiment of the invention is illustrated. A trade show display 150 is a first, second and third retractable banner stand 152, 154, 156 abutting against and/or connected together. The three banner stands are in the erected upright mode as illustrated and the collapsed transport mode as previously described. The three stands have respective first, second, and third banners 160, 162, 164 and suitable means for providing curvature to the banners. The adjacent banner edges 171, 172, 174, 175 may be connected by magnetic strips in the respective banner edges or other connection means such as hook and loop material or the like. See International Publication WO 01/35381 with Zarelius as an inventor, which discloses means of connecting adjacent banners or screens. Said Publication is incorporated herein by reference.

Figure 28:
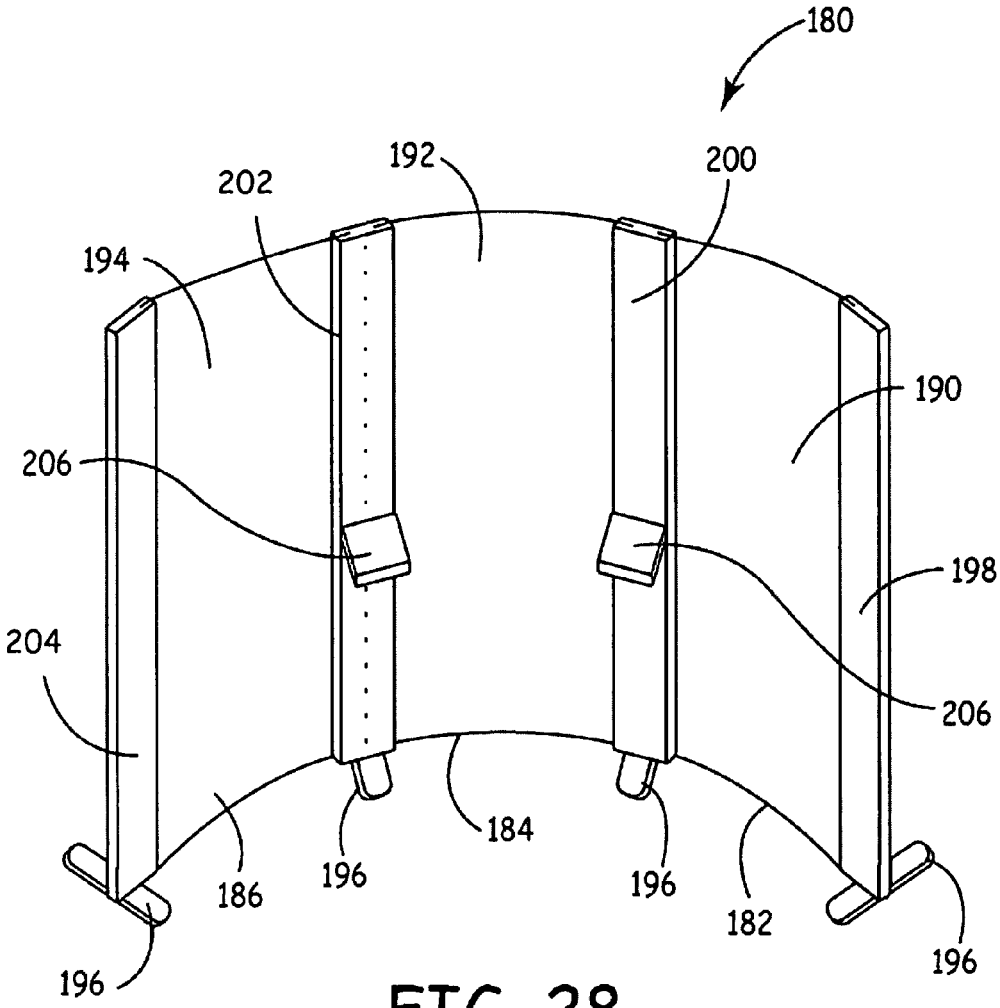
FIG. 28 is a perspective view of an embodiment of the invention using a plurality of retractable banner stands.
Figure 29:
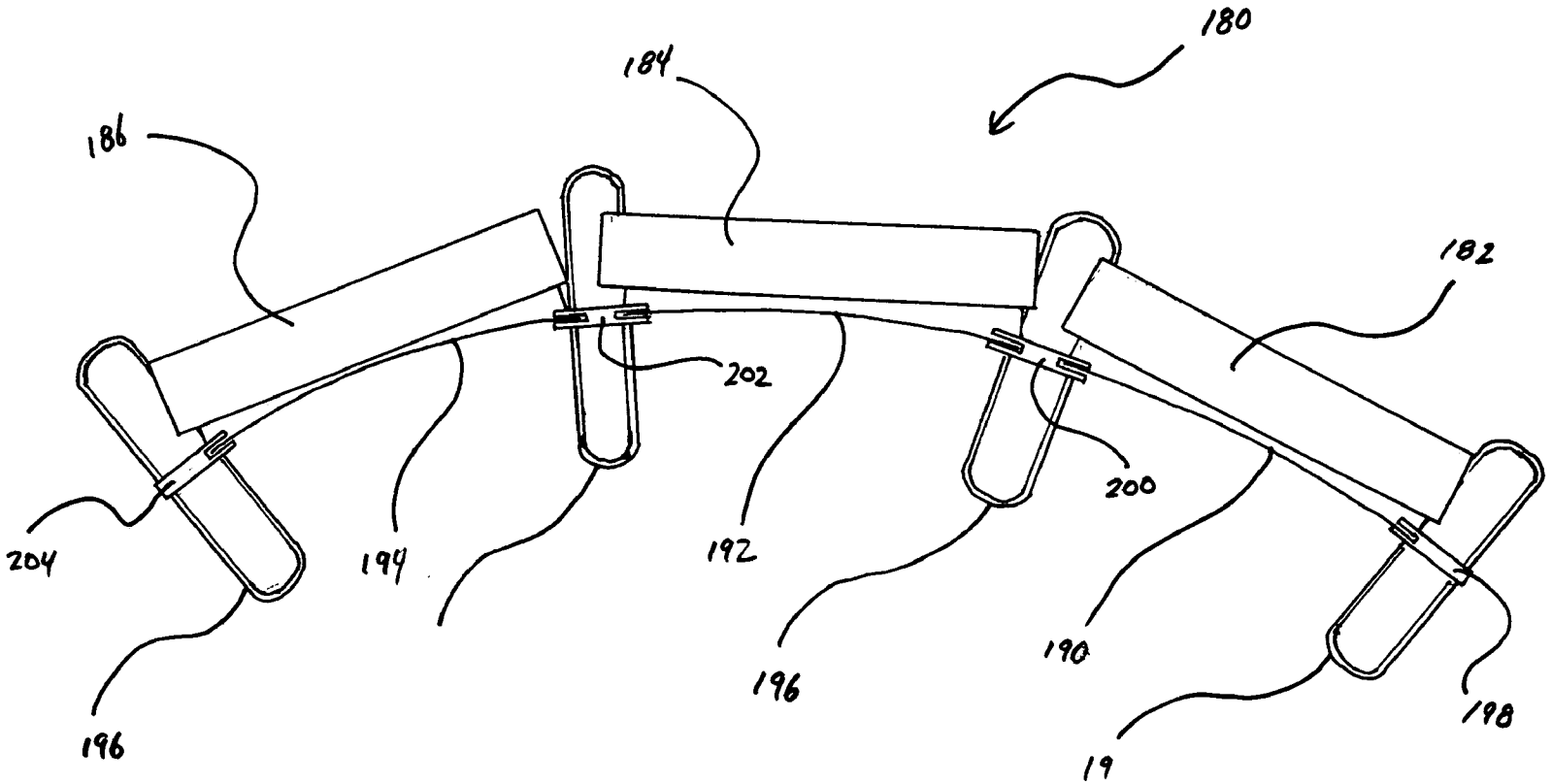
FIG. 29 is a top view of an embodiment of the invention using a plurality of retractable banner stands.

If two or more of the retractable banner stands with curvature means are placed adjacent to one another, the banner stands can be connected so that the series of banners create a semicircle or arc. By doing so, the display may be continuous and smooth from one display banner to the next adjacent banner. Alternatively, one or more retractable banner stands with curvature means can be used in conjunction with one or more retractable banner stands without curvature means to create different shaped configurations. Referring to FIGS. 28-29, another embodiment of the invention is illustrated. A tradeshow display 180 is a first, second and third retractable banner stand 182, 184, 186 abutting against and/or connected together. The three banner stands are in the erected upright mode as illustrated and the collapsed transport mode as previously described. The three stands have respective first, second, and third banners 190, 192, 194 and suitable means for providing curvature to the banners. In this embodiment, feet 196 are shared between adjacent retractable banner stands 10. Posts 198, 200, 202, 204 are then placed on the feet 196 shared between adjacent retractable banner stands. These posts 198, 200, 202, 204 then hide or cover the edges of the banner 190, 192, 194 and also offer product-holding capacity on a product-storing member 206. The product-storing member 206 could hold samples, brochures, business cards, flyers, or any other promotional materials. In other embodiments of the present invention, the product-holding 206 could be connected to a post, which is then connected to the housing 42, the at least one foot 66 or the feet 196, or to any other portion of the retractable banner stand 10.

Posts 198, 200, 202, 204 are depicted as having a generally H-shaped cross section. However, posts 198, 200, 202, 204 could have round, square, rectangular, octagonal, or another geometric cross sectional shapes.

Figure 24:
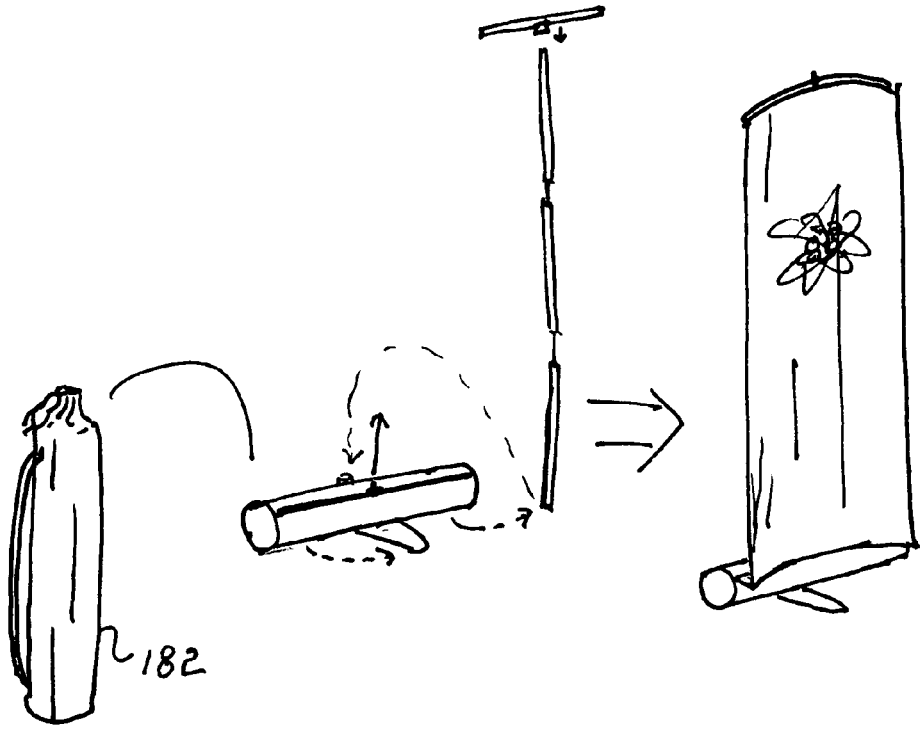
FIG. 24 is a pictorial drawing showing a banner stand in various stages of assembly.

Referring to FIG. 24, when the retractable banner stand 10 is in a fully retracted or collapsed transport mode, it can be placed into a carrying case or bag 182 for ease of storage and transport from a storage area to the place where it is to be dispensed and used for display. Basic steps in erecting a banner stand in accord with a preferred embodiment of the invention may be described as follows. At the place the stand is to be set-up, the housing is removed from the bag or case; the mast, is preferably lodged within a recess or nesting area of the housing is removed and assembled; the foot or feet on the housing are pivoted to provide a secure base; the mast is inserted into a receiving hole on the housing; the banner is extended and attached at the top of the mast; the curvature means is actuated or attached. If there are two or more stands, they are appropriately positioned adjacent one another and attached such as by the edges of the banners and/or other suitable locations. Although the preferred embodiment of the retractable banner stand has been described herein, numerous changes and variations can be made and the scope of the invention. For example, the means for providing curvature may provide a complex curve such as an S-shape in certain embodiments.

The invention claimed is:

1. A retractable banner stand having an erected upright mode and a collapsed transport mode, the banner stand comprising:

a banner formed of a flexible sheet material for suspending in a substantially upright open position, the banner having graphics thereon;

a housing comprising a core for winding the banner thereon and a retracting mechanism for unwinding and winding the banner with respect to the core;

a post extending upwardly from the housing;

a cross member presented with the post to support the banner when the banner is unwound from the housing; and a curved form selectively changeable from a first configuration into a curved configuration to selectively impart a curve to the banner when the banner is in the upright open position.

2. The retractable banner stand of claim 1 wherein the banner has a top and a bottom and the curved form is a first curved form engageable with the banner at the bottom and the banner stand further comprises a second curved form engageable with the banner at the top of the banner.

3. The retractable banner stand of claim 1 wherein the curved form is comprised of a resiliently flexible elongate member attached to the housing, the elongate member resiliently flexible between the curved configuration and the first configuration.

4. The retractable banner stand of claim 3 wherein the resiliently flexible elongate member has a pair of ends and the banner stand further comprises a plurality of spacers repeatably engageable with the ends of the of the elongate member for securing the elongate member in the curved configuration.

5. The retractable banner stand of claim 3 wherein the resiliently flexible elongate member has a cross-section with a greater dimension in a first plane and a lesser dimension in a second plane perpendicular to the first plane and wherein the greater dimension is at least four times the lesser dimension whereby the length is more readily flexible in the plane of the lesser dimension and wherein the plane of the lesser dimension is substantially horizontal when the retractable banner stand is erected.

6. The retractable banner stand of claim 1 wherein the curved form is comprised of a resiliently flexible elongate member, and wherein the banner has a elongate pocket for receiving the resiliently flexible elongate member therein and wherein the curved form is flexible between the curved configuration and the first configuration.

7. The retractable banner stand of claim 1 further comprising a lead-in portion attached intermediate the core and the banner, the lead-in portion being formed of a material more stretchable than the flexible sheet material of the banner.

8. A retractable banner stand comprising:

a banner formed of a flexible sheet material for suspending in a substantially upright and open position, the banner having graphics thereon;

a base for positioning the banner stand on one of a floor and table surface;

a core for winding the banner thereon and a retracting mechanism for unwinding and winding the banner with respect to the core;

an upright member extending from the base;

a cross member presented with the upright to support the banner when the banner is unwound from the core; and a curvature means selectively changeable from a first configuration into a curved configuration for selectively providing curvature to the banner at least when the banner is suspended in the substantially upright and open position.

9. The retractable banner stand of claim 8 wherein when the banner is substantially upright and open it has a top and a bottom, and wherein the curvature means comprises a first elongate member engageable with the bottom of the banner and a second elongate member engageable with the top of the banner.

10. The retractable banner stand of claim 9 wherein first and second elongate members are resiliently flexible and have a curved position for selectively providing the curvature to the banner and having a straight position.

11. The retractable banner stand of claim 10 wherein the curvature means comprises a curved form with a fixed curved surface for engaging the banner and providing the curvature.

12. The retractable banner stand of claim 10, wherein the curvature means comprises a first curved form engageable with the banner adjacent the base, and wherein the banner stand further comprises a second curved form engageable with the banner at a top of the banner when the banner is fully extended and upright.

13. The retractable banner stand of claim 12, wherein the curvature means comprises the core being flexible and a support portion for securing the core in a curved position to thereby impart the curvature to the banner.

14. The retractable banner stand of claim 8 further comprising a lead-in portion connected intermediate the banner and the core, the lead-in portion formed of a material more stretchable that the material of the banner.

15. A trade show display comprising:

a retractable banner stand having an erected upright mode and a collapsed transport mode, the banner stand comprising:

a banner formed of a flexible sheet material for suspending the banner in a substantially upright open position, the banner having graphics thereon;

a housing comprising a core for winding the banner thereon and a retracting mechanism for unwinding and winding the banner with respect to the core;

a cross member to support the banner when the banner is unwound from the housing; and a curved form selectively changeable from a first configuration into a curved configuration to selectively impart a curve to the banner when the banner is in the upright open position.

16. The trade show display of claim 15 wherein the retractable banner stand is a first banner stand and wherein the trade show display comprises a second banner stand, the second banner stand also having a erected upright mode and a collapsed transport mode, the second banner stand comprising:

a banner formed of a flexible sheet material for suspending the banner in a substantially upright open position, the banner having graphics thereon;

a housing comprising a core for winding the banner thereon and a retracting mechanism for unwinding and winding the banner with respect to the core;

a cross member presented on a post extending from the housing to support the banner when the banner is unwound from the housing;

a curved form for engaging with the banner when the banner is unwound and suspended in the upright position; and wherein the first banner stand is placeable adjacent the second banner stand whereby the two banners substantially abut one another.

17. The trade show display of claim 16 wherein the two banner stands are connectable with one another to fix their positions with respect to one another.

18. The trade show display of claim 16 wherein the first banner is connectable to the second banner to create the appearance that the first and second banner is a single continuous banner.

19. The trade show display of claim 18 further comprising a third banner stand like the first banner stand, the third banner stand having a third banner, the third banner stand connectable to one of the first and second banners whereby the three banners have the appearance of a single continuous banner.

20. A retractable banner stand having an erected upright mode and a collapsed transport mode, the banner stand comprising:

a banner formed of a flexible sheet material for suspending in a substantially upright open position, the banner having graphics thereon;

a housing comprising a core for winding the banner thereon and a retracting mechanism for unwinding and winding the banner with respect to the core;

a cross member to support the banner when the banner is unwound from the housing;

a curved form for engaging with the banner when the banner is unwound and suspended in the upright position, wherein the curved form is comprised of a resiliently flexible elongate member attached to the housing, the elongate member having a pair of ends and being resiliently flexible between a curved use position and a non-use position; and a plurality of spacers repeatably engageable with the ends of the elongate member for securing the elongate member in the curved use position.

21. A retractable banner stand having an erected upright mode and a collapsed transport mode, the banner stand comprising:

a banner formed of a flexible sheet material for suspending in a substantially upright open position, the banner having graphics thereon;

a housing comprising a core for winding the banner thereon and a retracting mechanism for unwinding and winding the banner with respect to the core;

a lead-in portion attached intermediate the core and the banner, the lead-in portion being formed of a material more stretchable than the flexible sheet material of the banner;

a cross member to support the banner when the banner is unwound from the housing; and a curved form for engaging with the banner when the banner is unwound and suspended in the upright position.

22. A banner stand comprising:

A banner formed of a flexible sheet material for suspending in an open position, the banner having graphics thereon;

A base selectively placeable on a surface, the base including a core for winding the banner thereon;

A retracting mechanism for unwinding and winding the banner with respect to the core;

A post extending upwardly from the base;

A cross member present with the post to support the banner in the open position; and a curved form presented with the base and changeable from a first configuration into a curved configuration to selectively impart a curve to the banner when the banner is in the open position.

* * * * *